US005803165A

United States Patent [19]

Shikazono et al.

[11] Patent Number: 5,803,165

[45] Date of Patent: Sep. 8, 1998

[54] HEAT EXCHANGER

[75] Inventors: Naoki Shikazono, Ibaraki-ken; Masaaki Itoh, Tsuchiura; Mari Uchida, Tsuchiura; Toshihiko Fukushima, Tsuchiura, all of Japan

[73] Assignee: Hitachi, Ltd., Tokyo, Japan

[21] Appl. No.: 665,519

[22] Filed: Jun. 17, 1996

[30] Foreign Application Priority Data

Jun. 19, 1995 [JP] Japan ..... 7-151636

[51] Int. Cl.[6] ..... F28F 1/40

[52] U.S. Cl. ..... 165/184; 165/133; 165/DIG. 525

[58] Field of Search ..... 165/133, 184

[56] References Cited

U.S. PATENT DOCUMENTS

| | | | |
|---|---|---|---|
| 4,166,498 | 9/1979 | Fujie et al. | 165/133 |
| 4,195,688 | 4/1980 | Fujie et al. | 165/133 |
| 4,245,695 | 1/1981 | Fujikake | 165/133 |
| 5,054,548 | 10/1991 | Zohler | 165/133 |
| 5,513,699 | 5/1996 | Menze et al. | 165/133 |
| 5,597,039 | 1/1997 | Rieger | 165/133 |

FOREIGN PATENT DOCUMENTS

| | | | |
|---|---|---|---|
| 54-16766 | 2/1979 | Japan | 165/133 |

*Primary Examiner*—Allen J. Flanigan

*Attorney, Agent, or Firm*—Antonelli, Terry, Stout & Kraus, LLP

[57] ABSTRACT

A heat exchanger, in which a plurality of fins formed on either an internal or an external face of a heat transfer tube, wherein each of the plurality of fins has a first portion including a fin top and a second portion including a fin root, and wherein the first portion has a ridgeline formed in a raised and recessed shape, or in a wave-like or corrugated shape, and the second portion has a substantially straight outline in a fin longitudinal direction in a cross section parallel to either the internal or the external face on which the plurality of fins are formed.

5 Claims, 17 Drawing Sheets

HEAT EXCHANGER

BACKGROUND OF THE INVENTION

1. Field of the Invention

The present invention relates to a heat exchanger that is used for a refrigerating/air conditioning machine, for example, and in particular to a finned heat transfer tube, which internally or externally has fins for the promotion of heat transfer; and to a finned thin film heat transfer surface, a heat exchanger, and a refrigerating/air conditioning machine.

2. Related Arts

Hitherto, in a finned heat transfer tube having fins on an inner surface thereof, it is known to work process for heat transfer promotion in heat transfer with condensation or boiling when a single refrigerant is used on side surfaces of the fins. As disclosing such art, the following two documents are given.

(1) Japanese Patent Unexamined Publication No. Sho 63-61896

In this prior art, on an internal surface of a small diameter heat transfer tube, and extending along its length, are formed either spiral or longitudinal fins, the side walls of which have a wave-like or corrugated shape. This structure increases mainly the size of a heat transfer area for heat transfer with condensation and the size of a wetted area for heat transfer with evaporation to improve heat transfer performance in a single refrigerant.

(2) Japanese Patent Unexamined Publication No. Sho 62-102093

In this prior art, in the side faces of spiral fins that are formed on and extend the length of the internal face of a heat transfer tube are formed sub-grooves, which are positioned at constant pitches and which are extended in the direction of the depth of the grooves. With this structure, heat transfer performance is improved when a single refrigerant is used.

In the prior art (1), described above, an entire fin including fin top and fin bottom, has a wave-like or corrugated shape. Thus, as the surface of the grooves between the fins also has a wave-like or corrugated shape, the effective heat transfer surface area is reduced and there is a problem of deterioration of heat transfer performance.

In the prior art (2), described above, the fin tops are straight and in the side walls sub-grooves are formed from the upper to the bottom portions to increase the heat transfer area. With this structure, the expected improvement in heat transfer cannot be realized.

SUMMARY OF THE INVENTION

It is therefore one object of the present invention to provide a heat exchanger that can improve the heat transfer with condensation and with boiling.

To achieve the above object, according to the present invention, provided is a heat exchanger, which has a plurality of fins formed on either an internal or an external face of a heat transfer tube, wherein each of the plurality of fins has a first portion, including a fin top, and a second portion, including a fin root, and wherein the first portion has a ridgeline formed in a concavo-convex shape, or in a wave-like or corrugated shape, and the second portion has a substantially straight outline, in a fin longitudinal direction, in a cross section parallel to either the internal or the external face on which the plurality of fins are formed.

In the heat transfer tube in the prior art (1) described above, the lower portions of the grooves between the fins are filled with liquid in heat transfer with condensation, and a steam phase does not exist. Therefore, even though the lower portions of the grooves are corrugated, much improvement in heat transfer performance by the increase in the heat transfer area cannot be expected. Further, although in heat transfer with evaporation a refrigerant stream that flows in the groove is drawn up to the upper portions of the fins by capillary action and the size of a wetted area is increased, the lower portion of the groove, even if it is not corrugated, will be necessarily filled with liquid by the capillary action of the groove itself and the shear force that is applied to the vapor-liquid surface. In addition, the corrugated shape of the lower portions of the fins may prevent the flow of liquid in the grooves and it may also interfere with the flow of liquid during condensation and the supply of liquid during evaporation, and therefore there will be a resulting degradation in the heat transfer performance.

Further, in the prior art (2), a portion most contributing to the heat transfer in the heat transfer with condensation is the vicinity of fin top on which liquid film is the thinnest. However, the area at the top of fin is straight and the heat transfer area is not increased, so that the heat transfer performance is not much improved. Further, although sub-grooves are formed from the upper portion to the lower portion of the sides of fin, the lower portion of the grooves between adjacent fins are filled with liquid, as is described above, so that at the sub-grooves in the lower portion of the side of fin no enhancement of the heat exchange effect is provided by the increase in the size of the heat transfer area. In addition, in the heat transfer with evaporation, a refrigerant stream that flows in a groove is pulled up to the upper portions of fins by capillary action, so that the size of the wetted area is increased. Similarly to the prior art (1), however, even without guiding liquid by the sub-grooves, the lower portions of the grooves are necessarily filled with the liquid by the capillary action of the main grooves themselves and the shear force of a vapor-liquid surface. Adversely, the flow of liquid may be interrupted.

On the other hand, according to the present invention, since only the upper portions of the fins are corrugated, surface tension acts effectively during the heat transfer with evaporation, and this force acts on the liquid that is retained in the convex portion of the fin top in such a manner as to pull the liquid down to the lower fin portion. As a result, the size of a dry area (a thin film area that contributes to heat transfer) at the upper fin portion is increased, and the size of the effective heat transfer area of the entire fin is effectively increased, so that the heat transfer performance is enhanced.

Since at the heat transfer with evaporation, the concave portion in the upper fin portion acts to pull the liquid, which flows in the lower fin portion, up to the fin top by capillary action, the size of the wetted area on the internal face of the heat transfer tube is increased, and the size of the effective heat transfer area is increased, and the heat transfer performance is improved.

BRIEF DESCRIPTION OF THE DRAWINGS

FIG. 8 is a vapor-liquid equilibrium graph for a refrigerant mixture of HFC-32 and HFC-134a;

DETAILED DESCRIPTION OF THE PREFERRED EMBODIMENTS

The preferred embodiments of the present invention will now be described while referring to the accompanying drawings. To make it easier to understand the structure, shading is provided for several perspective views.

A first embodiment of the present invention will be described while referring to FIGS. 1 through 16.

Figure 1:
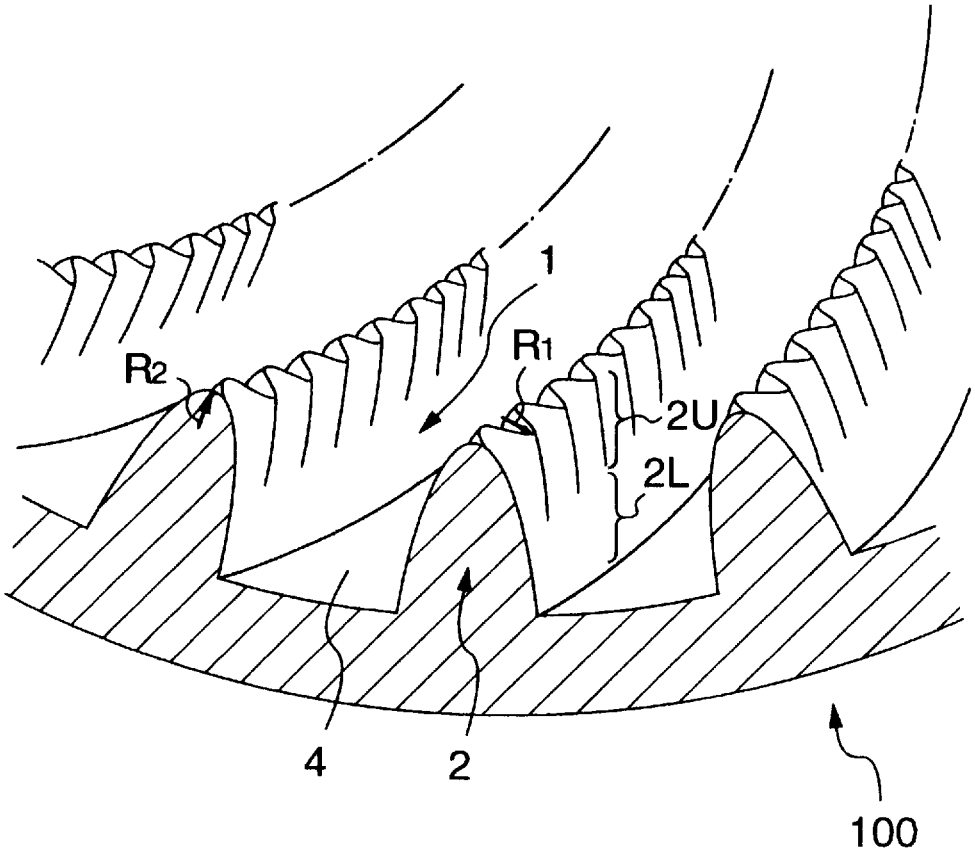
FIG. 1 is a partially enlarged, cross sectional view of the detailed structure of a finned heat transfer tube according to a first embodiment of the present invention.
Figure 2:
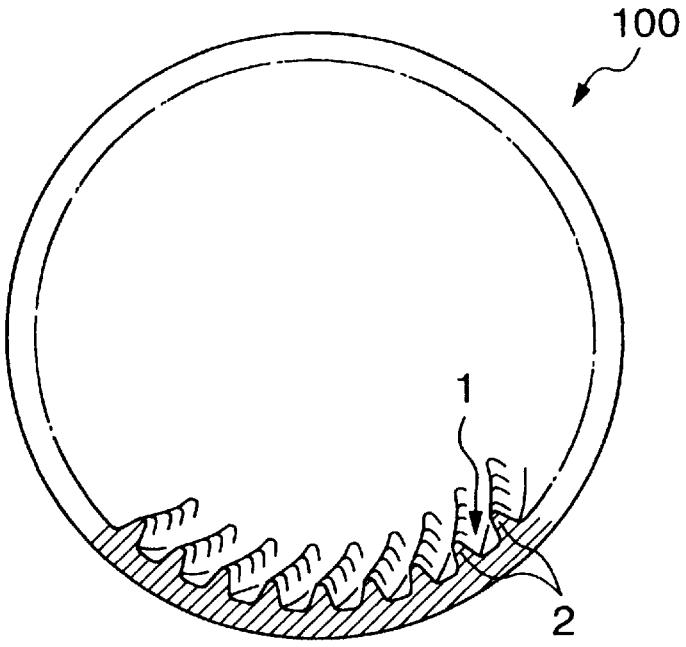
FIG. 2 is a cross sectional view of the finned heat transfer tube in FIG. 1.

The structure of a finned heat transfer tube according to this embodiment is shown in FIGS. 1 and 2. FIG. 2 is a cross sectional view of the finned heat transfer tube, and FIG. 1 is a partially enlarged transverse cross sectional view of the detailed structure of the finned heat transfer tube.

In FIGS. 1 and 2, a plurality of fins 2 are formed as a spiral on and extend along an internal face 4 of a heat transfer tube 100. Spiral grooves 1 are formed between adjacent fins 2. Each of the fins 2 has an upper region 2U, which has a concavo-convex outline, or a substantially corrugated outline, in the longitudinal direction of the fin in a cross section parallel to the internal face 4 of the heat transfer tube 100; and a lower region 2L, which in has a substantially straight outline in the cross section parallel to the internal face 4 of the heat transfer tube 100. In the upper region 2U, the radius of curvature R1 of the concavo-convex outline of the distal fin end in the cross section parallel to the internal face 4 of the heat transfer tube 100 the radius of curvature R2 of the fin end in a cross section perpendicular to the internal face 4 are structured so as to satisfy $R1 \geq R2$.

As a liquid or gas such as a single refrigerant (for example, HCFC-22) or a non-azeotropic mixture refrigerant (for example, a refrigerant mixture of HFC-32 and HFC-134a) flows in the thus structured heat transfer tube 100, heat is then exchanged with the outside of the heat transfer tube 100 by the heat transfer with condensation or the heat transfer with boiling.

The operation of the embodiment will now be explained.

Figure 3:
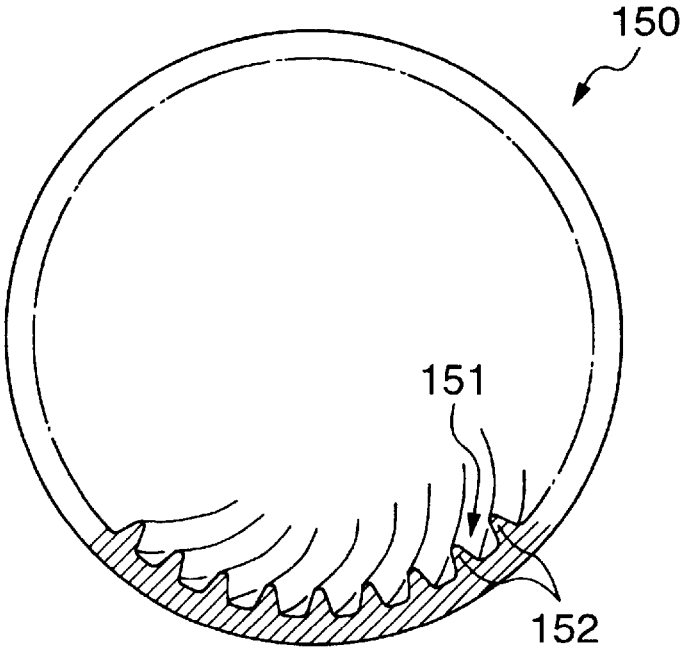
FIG. 3 PRIOR ART
FIG. 3 is a cross sectional view of a conventional finned heat transfer tube.

As an example for comparison with this embodiment, in FIG. 3 is shown a cross section of a conventional finned heat transfer finned tube (a heat transfer tube with spiral internal grooves) 150, which is employed for a cross-in tube type heat exchanger.

In FIG. 3, a plurality of fins 152 are formed as a spiral on the internal face of the heat transfer tube 150, and spiral grooves 151 are formed between adjacent fins 152. Each of the fins 152 has a substantially straight outline in the cross section parallel to the internal face of the heat transfer tube 150.

The internal diameter of the heat transfer tube 150 is 6 to 10 mm; the depth of a groove is 0.1 to 0.3 mm; the groove pitch is 0.2 to 0,.6 mm; the spiral groove angle (angle in which the groove is twisted) is 0 to 25 degrees; the groove is shaped as a trapezoid; and the distal fin end angle is 30 to 40 degrees.

Figure 4:
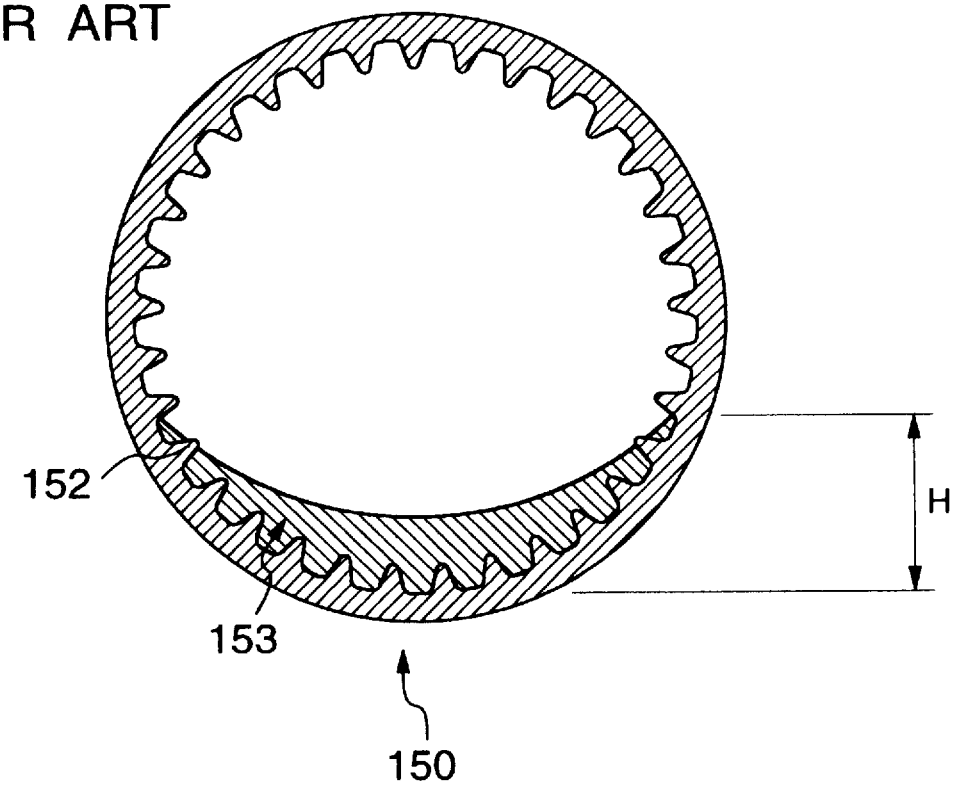
FIG. 4 PRIOR ART
FIG. 4 is a cross sectional view of a conventional finned heat transfer tube and showing distribution of the liquid retained in the pipe.
Figure 5:
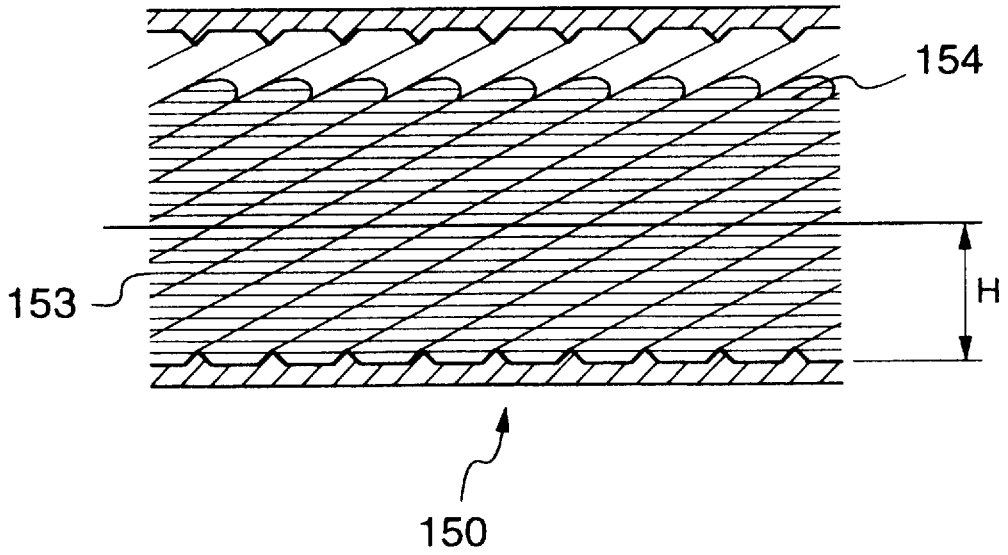
FIG. 5 PRIOR ART
FIG. 5 is a longitudinal cross sectional view of the conventional finned heat transfer tube and showing the rising of liquid in grooves.

The action when a single refrigerant or a pseudo azeotropic mixture refrigerant flows through the above described finned heat transfer tube 150 to perform heat transfer with condensation and with evaporation will now be explained. The refrigerant flows in the heat transfer tube 150 in vapor-liquid two phase flow, and in a small flow rate range, the refrigerant flows as a stratified stream, with heavy liquid 153 flowing at the bottom of the tube 150 and light steam flowing in the upper portion of the tube, as is shown in FIG. 4. Wetting of the tube wall that is located at a specific height above the liquid surface of the stratified stream will now be explained. FIG. 5 is a longitudinal cross section of FIG. 4, and shows a condition in which in the spiral grooves of the tube wall, the liquid 154 is pulled up above a liquid surface height H by capillary action.

Figure 6:
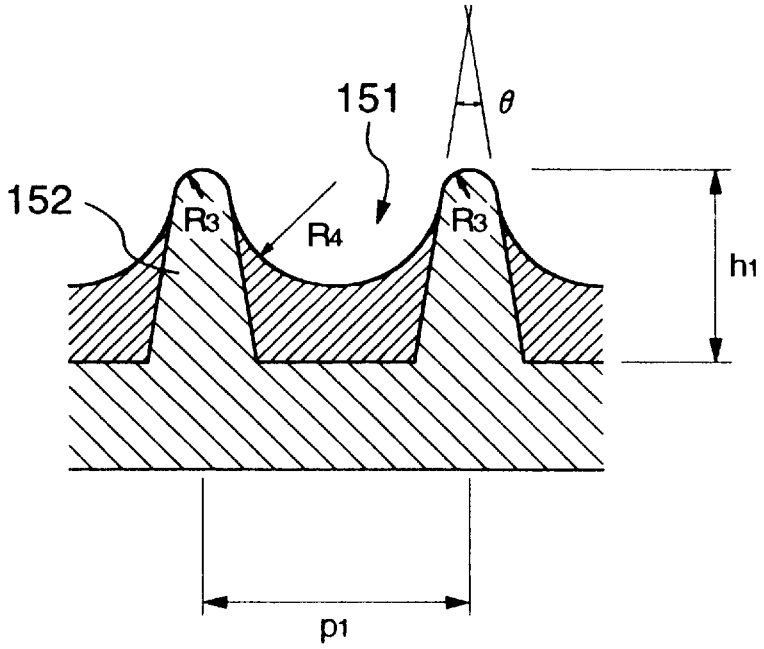
FIG. 6 PRIOR ART
FIG. 6 is an enlarged cross sectional view of the grooves of the conventional finned heat transfer tube and showing distribution of liquid retained therein.
Figure 7:
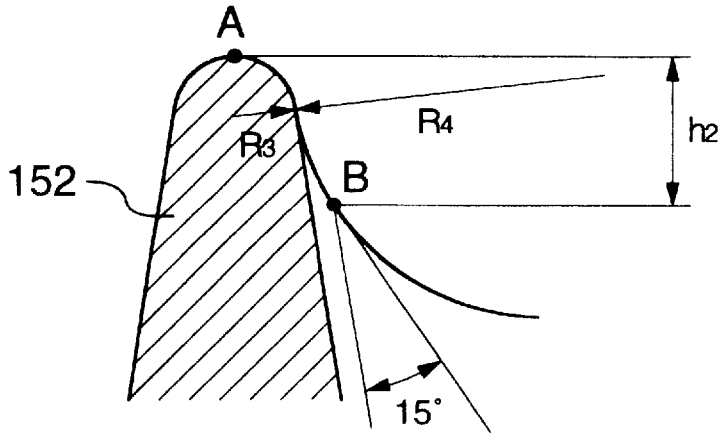
FIG. 7 PRIOR ART
FIG. 7 is an enlarged diagram showing an internal fin of the conventional finned heat transfer tube and showing liquid distribution thereat.

In FIG. 6 is shown the liquid that is retained in the grooves of a conventional heat transfer tube having spiral grooves. The vapor-liquid surface can be approximated to an arc having a radius of curvature R4 in contact with arc shaped distal fin ends having a radius of curvature R3. This is because the influence exerted by surface tension is dominant in a minute groove. When, as is shown in FIG. 7, a thin liquid film region h2 is defined as a distance from the distal fin end A to point B, where the fin side face and the vapor-liquid surface form an angle of 15 degrees ($\pi/12$), h2 is represented by expression 1:

$$h_2 = r_1 \frac{p}{2} \tan\frac{\theta}{2} + \frac{p}{2} \frac{\sin\left(\frac{\pi}{12} + \frac{\theta}{2}\right)}{\cos\frac{\theta}{2}} - r_1 \sin\left(\frac{\pi}{12} + \frac{\theta}{2}\right) \quad (1)$$

wherein $\theta$ defines the vertex angle of a fin; p1, a fin pitch; and h1, the height of a fin. With a tube diameter of 7 mm, 60 fins, fin height H1=0.2 mm, a fin vertex angle of 40 degrees and R3=0.04 mm, for example, the height h2 of the thin liquid film region is about 0.059 mm. With a tube diameter of 7 mm, 57 fins, fin height h1=0.25 mm, a fin vertex angle of 15 degrees and R3=0.035 mm, h2 is approximately 0.067 mm. Therefore, it is found that the thin liquid film region is a region between about 30% of the fin height and the distal fin end.

A very thin film is formed on the distal fin end region, and with this, a higher rate of the heat transfer with condensation can be attained. This is because of the surface tension effect, i.e., because, as is indicated by $\Delta P=\sigma/R3$, the pressure on the liquid film at the fin top becomes higher than the ambient pressure in a vapor phase, the surface of the liquid that is retained in the grooves between the fins is depressed and thus the pressure on the liquid becomes lower than the vapor-phase pressure, so that the liquid at the fin top is discharged into the grooves between the fins by pressure difference. Further, during evaporation, if the flow in the side of the fin root from this position is not interrupted, the liquid is constantly supplied to the top of the tube without being exhausted, and a high rate of heat transfer with evaporation can be attained. It is known hitherto that a three-dimensional heat transfer surface can effectively enhance the rate of heat transfer condensation. However, if the internally provided fins are completely separated, the flow of liquid is interrupted during the evaporation, as is described above, and such a heat transfer tube is not appropriate for the employment with a heat pump.

The action performed when the non-azeotropic mixture refrigerant flows in the finned heat transfer tube 150 to perform the heat transfer with condensation will now be described.

Figure 8:
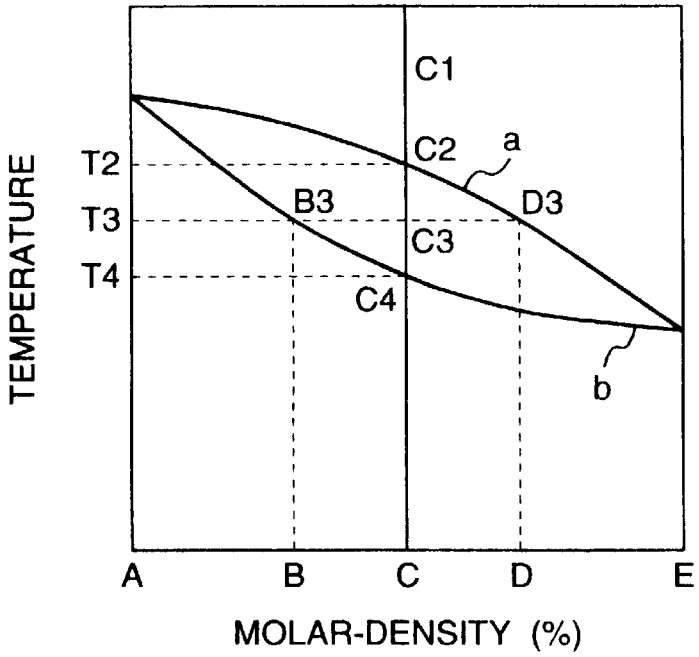

First, in FIG. 8 is shown a vapor-liquid equilibrium graph for a refrigerant mixture of HFC-32 and HFC-134a that is employed as an example of non-azeotropic mixture refrigerant. The horizontal axis represents molar-density of HFC-32, and the vertical axis represents temperature.

In FIG. 8, the dew-point curve (a) represents the temperature at which condensation starts, and at temperature above this curve, the non-azeotropic mixture refrigerant is in the steam vapor state. A boiling-point curve (b) represents the temperature at which boiling starts, and at temperature below this curve, the non-azeotropic mixture refrigerant is in the liquid state.

Let us study, for example, a process wherein a non-azeotropic mixture refrigerant of which molar-density HFC-32 is C, is gradually cooled down from the steam vapor state C1 to the liquid state. When steam in state C1 is cooled down to state C2 at temperature T2, the temperature reaches the dew-point temperature and condensation begins. Then, when the temperature is reduced further through temperature T3 to temperature T4, where the non-azeotropic mixture refrigerant enters in state C4, the condensation is completed. In this fashion, the temperature of condensation of the non-azeotropic mixture refrigerant is not constant but is varied within a specific range.

In addition, the concentration of the non-azeotropic mixture refrigerant in the liquid state differs from the concentration of the refrigerant to be condensed that remains in the steam vapor state. In other words, at temperature T3 in the above described process, the HFC-32 concentration does not become C (i.e., the state C3), and the refrigerant is divided into condensed liquid, for which the HFC-32 concentration is B (i.e., state B3), and steam, for which the HFC-32 concentration is D (i.e., state D3). This is because HFC-32 is difficult to condense compared with HFC-134a, and at the condensed liquid surface the HFC-32 concentration of the liquid is low and the HFC-134a concentration is high, while for the remaining steam the HFC-32 concentration is increased and the HFC-134a concentration is reduced.

As a result of these condensation behaviors, resulted is in the vicinity of the vapor-liquid surface a concentration distribution including a region (hereafter referred as a concentration boundary layer for convenience sake) where the HFC-32 concentration of the steam is high and a region where the HFC-32 concentration of the liquid is low.

Figure 9:
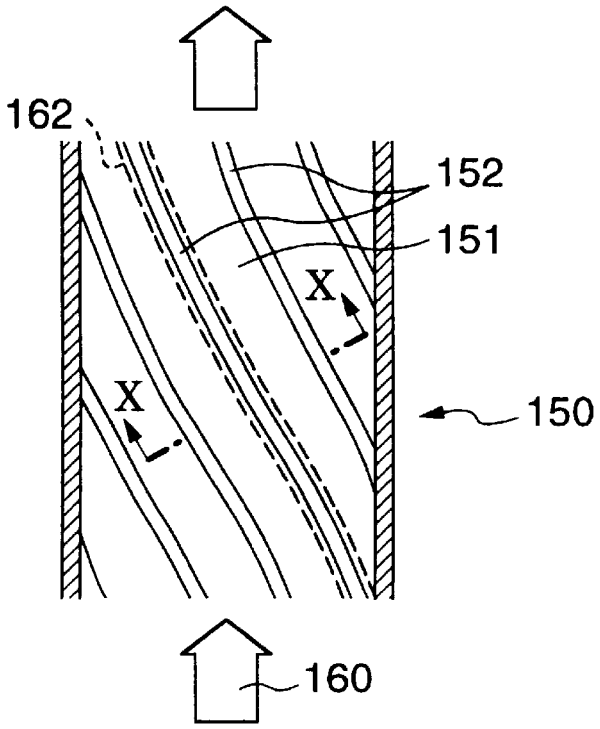
FIG. 9 is a longitudinal cross sectional view of a heat transfer tube in which a concentration boundary layer is generated.

The process where the concentration boundary layer is formed in this manner will now be explained while referring to FIGS. 9 and 10. FIG. 9 is a horizontal, longitudinal cross sectional view of the heat transfer tube 150, and FIG. 10 is a partial cross sectional view taken along line X—X in FIG. 9.

Figure 10:
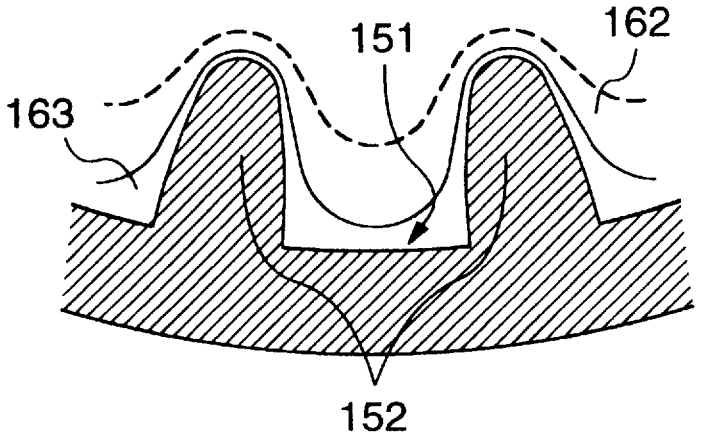
FIG. 10 is a partial cross sectional view taken along line X—X in FIG. 9.

In FIGS. 9 and 10, the non-azeotropic mixture refrigerant gas flow 160 near the tube wall is guided along the fins 152 and the spiral grooves 151 between the fins 152 in the direction of the spiral. At this time, HFC-134a, of the non-azeotropic mixture refrigerant, which is comparatively easy to condense, is first condensed into a liquid at inside the heat transfer tube 150 and liquid film 163 is thus formed. HFC-32, on the other hand, which is comparatively difficult to condense, remains in the vapor phase and forms a concentration boundary layer 162 on the liquid film 163 along the fins 152.

The concentration boundary layer 162 becomes thicker in the direction of flow as it continues, so that it prevents the dispersion of the HFC-134a on the tube wall as well as the condensation of steam of the concentration C that exists in the center of the heat transfer tube 150. Thus, the performance of the heat transfer with condensation when using the non-azeotropic mixture refrigerant in the heat transfer tube 150 is degraded compared with the that of a single refrigerant. This will be described with referring to FIG. 11.

Figure 11:
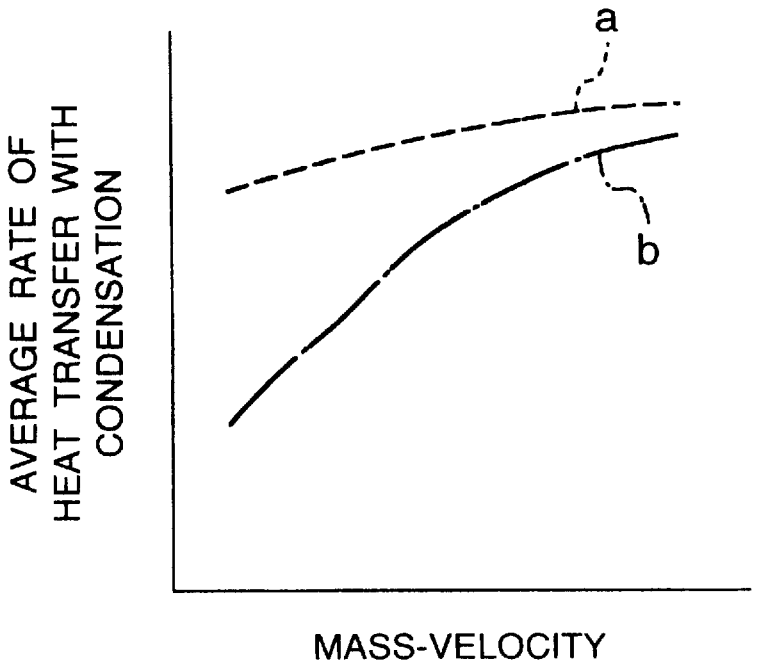
FIG. 11 is a graph showing an average rate of heat transfer with condensation obtained when a single refrigerant is used, and an average rate of heat transfer with condensation obtained when a non-azeotropic mixture refrigerant is used in the conventional heat transfer tube shown in FIG. 3.

FIG. 11 is a graph showing the average rate of heat transfer with condensation that are obtained when a single refrigerant and a non-azeotropic refrigerant are used in the heat transfer tube 150. HCFC-22 is employed as the single refrigerant, and a mixture of HFC-32, HFC-125 and HFC-134a at 30, 10 and 60 wt % is employed as the non-azeotropic mixture refrigerant. The horizontal axis represents mass velocity.

In FIG. 11, curve (a) represents the average rate of the heat transfer with condensation when the single refrigerant, and curve (b) represents the average rate of the heat transfer with condensation when the non-azeotropic mixture refrigerant is used. As is apparent from the graph, in the heat transfer tube 150, the rate of heat transfer with condensation when using the non-azeotropic mixture refrigerant is lower than that when using the single refrigerant.

For a comparison with the conventional finned heat transfer tube 150, the operation of the heat finned transfer tube 100 for this embodiment when using the single refrigerant, the pseudo azeotropic mixture refrigerant, or the non-azeotropic mixture refrigerant, will now be explained, while referring to FIGS. 12 through 15, for the heat transfer with condensation and the heat transfer with evaporation.

Figure 12:
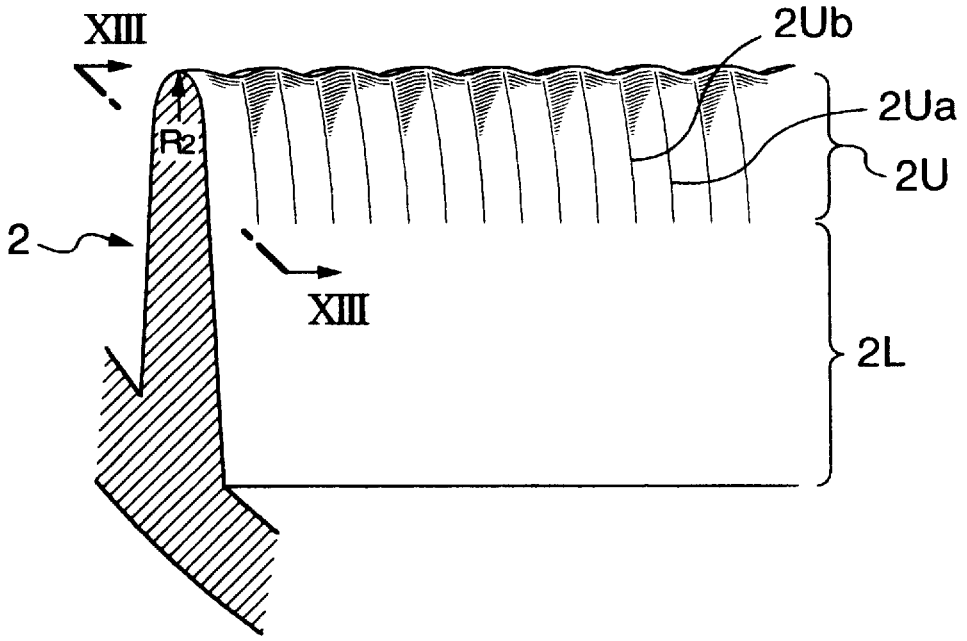
FIG. 12 is a perspective view of the vicinity of the end of fins that are formed in the heat transfer tube in FIG. 1.
Figure 13:
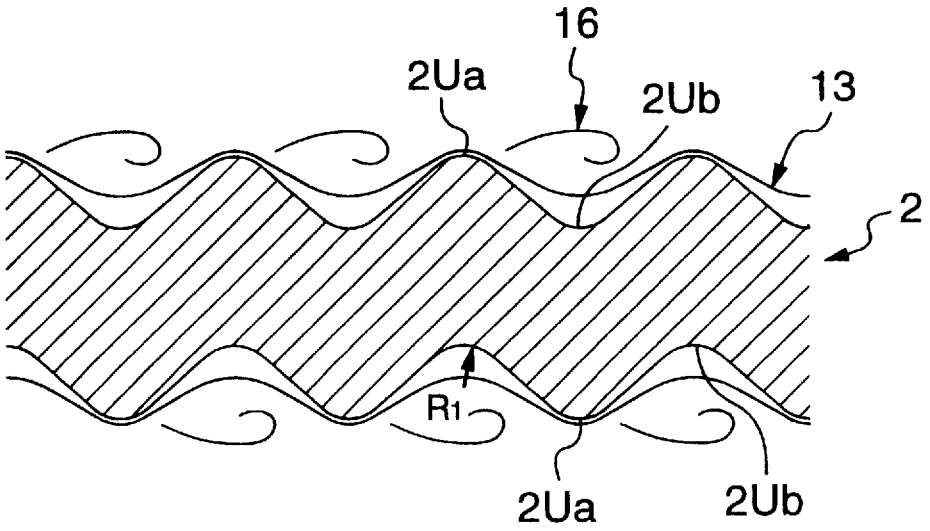
FIG. 13 is a cross sectional view taken along line XIII—XIII in FIG. 12.

(1) Operation for improving the rate of heat transfer with condensation in the upper region 2U FIG. 12 is a perspective view of the vicinity of the end of the fins that are formed in the heat transfer tube 100 in this embodiment, and FIG. 13 is a longitudinal cross sectional view, taken along line XIII—XIII in FIG. 12, of the action upon heat transferring with evaporation.

In FIGS. 12 and 13, in the finned heat transfer tube 100 in this embodiment, recessed portions 2U*b* and raised portions 2U*a* are formed in the upper region 2U, of the fin 2 which is corrugated in its cross section. Since a thin liquid film 13, which contributes most to the heat transfer at the distal end of the fin 2, can be further thinned by the provision of the raised portions 2U*a*, and the area where the thin liquid film 13 exists can also be increased, the heat transfer performance can be improved. When the non-azeotropic mixture refrigerant is used, as is shown in FIG. 13, a steam stream is agitated by a separating vortex 16 that occurs at the raised portions 2U*a* of the upper region 2U, and the concentration boundary layer 162 (see FIGS. 9 and 10) becomes thinner, so that the heat of the non-azeotropic mixture refrigerant gas and the shifting of the material can be increased.

The liquid film driving force due to surface tension at the distal fin end of the prior art fin is represented by only the radius of curvature R2, as is indicated as $\Delta P=\sigma/R2$. In this embodiment, however, since the radius of curvature is present not only at the portion R2 but also at the portion R1, the liquid film driving force is described as $\Delta P=\sigma/R2+\sigma/R1$. Thus, as the effect that is obtained from the radius of curvature R1 at the raised portion 2U*a* is additionally provided, the force for pulling the liquid retained at the fin top down to the fin lower portion becomes stronger than the conventional force. As a result, the liquid film that is the cause of heat resistance becomes thin and the rate of heat transfer with condensation is increased.

In addition, at this time, in the upper region 2U (radius of curvature R1 of the corrugation at the distal fin end)≈(radius of curvature R2 of the raised shape). When the radius of curvature R1 is large, the wavy shape of the upper region 2U is similar to the conventional shape and the effect by the surface tension is reduced. When the radius of curvature R1 is too small, the shape of the upper region 2U is equivalent to one where merely scratches are formed on the conventional fin and the effect of the surface tension is also reduced. It is, therefore, preferable that the radius of curvature R1 be substantially near that of the radius of curvature R2 of the distal fin end in a range within which the surface tension is effective. This can be applied for the heat transfer with evaporation, which will be described later. More specifically, it is preferable that the upper region 2U be so formed that the raised portions and the recessed portions be alternately repeated at pitches substantially equaling the diameter b of the radius of curvature R1 at the distal fin end (2R1=b, and if the fin has a trapezoid shape, the length of its short side b). With this formation, in the recessed portions 2U*b* the liquid film is not easily discharged downward from the distal fin end, and the distal fin end can be prevented from becoming covered with a thick liquid film.

This effect of improving the heat transfer with condensation will be more specifically described with reference to FIGS. 14 and 15.

Figure 14:
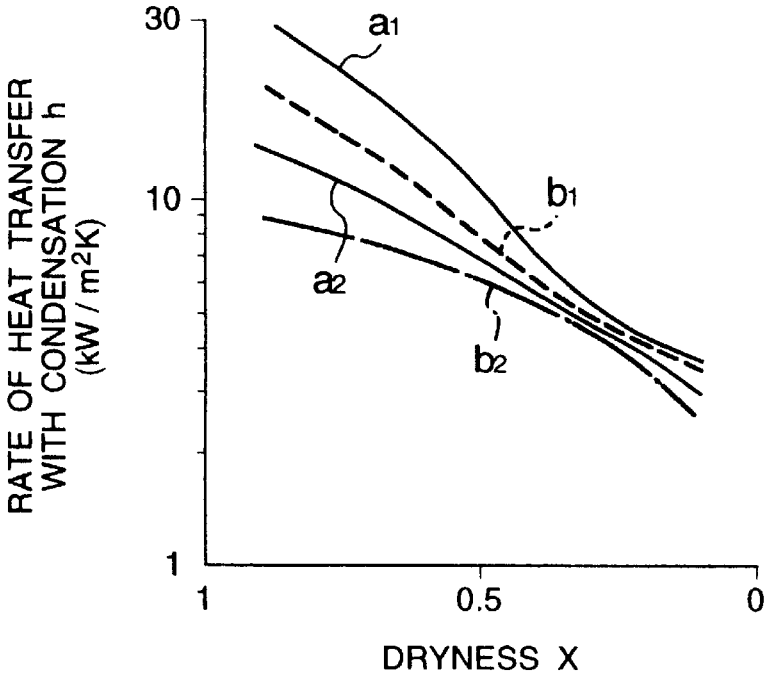
FIG. 14 is a graph showing, for the heat transfer tube in FIG. 1 and the conventional heat transfer tube in FIG. 3, the rates of heat transfer with condensation obtained when a single refrigerant is used and when a non-azeotropic mixture refrigerant is used.

FIG. 14 shows a graph of the rates of heat transfer with condensation obtained when the single refrigerant (HCFC-22) and the non-azeotropic mixture refrigerant (a mixture of HFC-32 30 wt %, HFC-125 10 wt %, and HFC-134a 60 wt %) are respectively made flow in the finned heat transfer tube 100 of this embodiment and the above-described prior art finned heat transfer tube 150.

In FIG. 14, the curve (b1) and the curve (b2) respectively designate the cases in which the single refrigerant and the non-azeotropic mixture refrigerant are made flow in the prior art finned heat transfer tube 150 and the curve (a1) and the curve (2) respectively designate the cases in which the single refrigerant and the non-azeotropic mixture refrigerant are made flow in the finned heat transfer tube 100 of this embodiment and the horizontal axis denotes dryness.

As is apparent from FIG. 14, the finned heat transfer tube 100 of this embodiment can improve the rate of heat transfer in a wide range of the dryness for the single refrigerant and for the non-azeotropic mixture refrigerant in comparison with the prior art heat transfer tube 150. Further, since the curve (a2) and the curve (b1) are relatively close to each other, when the non-azeotropic mixture refrigerant is made flow in the heat transfer tube 100 of this embodiment, a rate of heat transfer with condensation similar to that when the single refrigerant is made flow in the prior art heat transfer tube 150 can be obtained.

Figure 15:
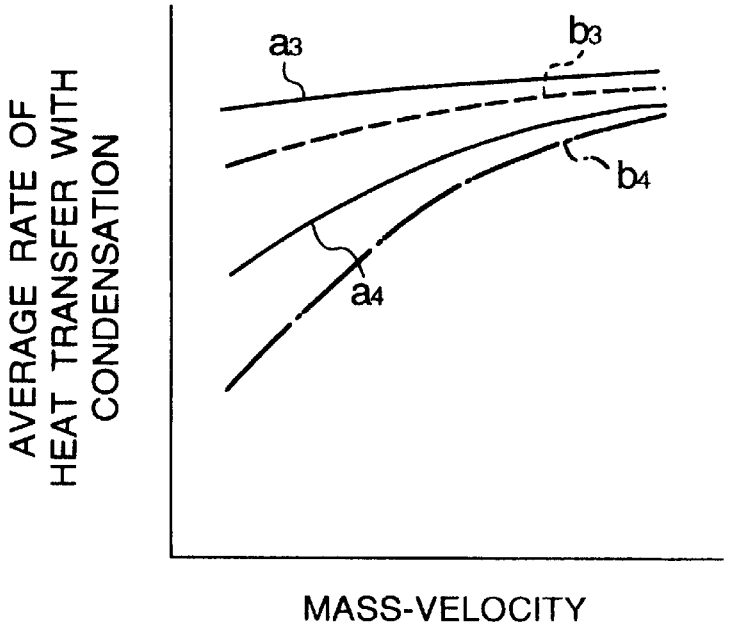
FIG. 15 is a graph showing, for the heat transfer tube in FIG. 1 and the conventional heat transfer tube in FIG. 3, average rates of heat transfer with condensation obtained when a single refrigerant is used and average rates of heat transfer with condensation obtained when a non-azeotropic mixture refrigerant is used.

The graph in FIG. 15 shows the dependency on mass velocity of the averaged rates of heat transfer with condensation for the finned heat transfer tube 100 in this embodiment, and for the above described conventional finned heat transfer tube 100 when the single refrigerant (HCFC-22) flows through it, and when the non-azeotropic mixture refrigerant (a refrigerant obtained by mixing HFC- 32, HFC-125 and HFC-134a at 30, 10 and 60 wt %, respectively) flows through it.

In FIG. 15, curve (b3) represents the case of the single refrigerant through the conventional heat transfer tube 150, and curve (b4) represents the case of the non-azeotropic mixture refrigerant through the conventional heat transfer tube 150. Curve (a3) represents the case of the single refrigerant through the heat transfer tube 100 in this embodiment, and curve (a4) represents the case of the non-azeotropic mixture refrigerant through the heat transfer tube 100 in this embodiment. The horizontal axis represents mass velocity.

As is shown in FIG. 15, the average heat transfer rate for the heat transfer tube 100 in this embodiment is higher in a wide mass velocity range than that for the conventional heat transfer tube 150, both when the single refrigerant is employed and when the non-azeotropic mixture refrigerant is employed.

Figure 16:
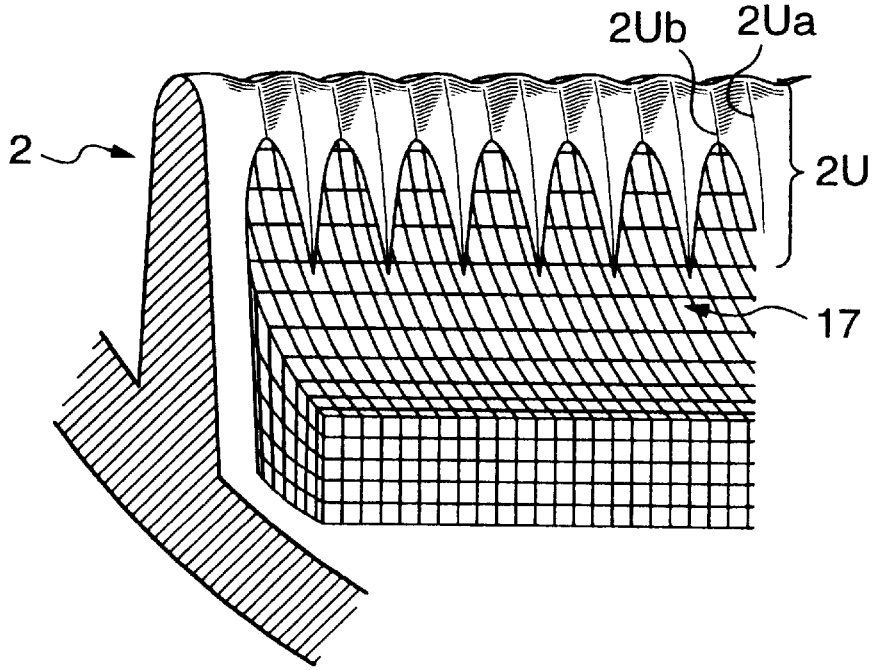
FIG. 16 is a perspective view the vicinity of the end of the fins and showing behavior at the time of heat transfer with boiling in the heat transfer tube in FIG. 1.

(2) Operation for improving the heat transfer with evaporation in the upper region 2U FIG. 16 is a perspective view, of the area in the vicinity of the end of the fin 2, for illustrating the action in the finned heat transfer tube 100 of this embodiment at the time of heat transfer with evaporation.

In FIG. 16, for the finned heat transfer tube 100 in this embodiment, a liquid refrigerant 17 can be attracted toward the distal fin end by using the capillary action that occurs at the recessed portions 2U*b* of the upper region 2U of the fin 2, and the wetted area inside the heat transfer tube can be increased. As a result, the heat transfer performance can be improved. The liquid film driving force that is at the distal fin end of the prior art fin due to surface tension is the force by which liquid is discharged using a pressure difference indicated by $\Delta P=\sigma/R2$. In this embodiment, however, because of the radius of curvature R1 of the recessed portions 2U*b*, which is as represented in $\Delta P=\sigma/R2-\sigma/R1$, the liquid discharge effect is reduced. As a result, the area that is wetted by liquid is increased at the upper portion of the fin 2, and a high heat transfer rate with evaporation can be obtained at the upper recessed portions 2U*b* of the fin 2.

(3) Operation at the lower regions 2L

Referring back to FIG. 12, the lower regions 2L of the fins 2 of the heat transfer tube 100 of this embodiment are so formed that in longitudinal cross section they are almost straight, and they are not raised and recessed. Since the lower regions 2L of the fins 2 are filled with liquid during the heat transfer with condensation, these regions do not substantially affect the improvement in the heat transfer effect that is obtained by increasing the heat transfer area. Further, since the lower regions 2L of the fins 2 are also filled with liquid due to the capillary action of the primary groove, the lower regions 2L do not substantially affect the improvement in the heat transfer with evaporation, as well as the heat transfer with condensation. In other words, the shape of the lower regions 2L of the fins 2 that do not have a wave-like cross section do not cause deterioration of the heat transfer performance. If the lower regions 2L in a groove are formed with raised and recessed shapes, the liquid flow in the groove may be interrupted. In addition, the flow of condensed liquid may be prevented during the condensation, while the supply of the liquid to the top of the tube may be interfered with during the evaporation, and deterioration of the heat transfer performance may occur. Therefore, the lower regions 2L of the fins 2 should be formed substantially straight so as to provide little resistance.

From the view point of the machining of the fin 2, since the longitudinal cross sectional view of the lower region 2L is almost straight and is not recessed and raised, or wave-like, only the thin upper region 2U needs to be worked. Therefore, accurate machining is easily performed, when compared with the conventional process for working the entire upper and lower regions of the fin 2 into a corrugated shape.

As is described in (1) through (3), therefore, the finned heat transfer tube 100 in this embodiment can improve the heat transfer performance and can be produced easily and accurately. Since the area where liquid film is thin of the conventional grooved heat transfer tube is in a region of about 30% of the height of the fin from its top, the upper region 2V of the fin may be positioned within the upper 30% of the height of the fin 2.

Although, in the first embodiment, the wave phases of the upper and lower regions of the fin 2 have been aligned, the phases of the waves may differ in the upper and lower regions. In this case, the same effect can be also obtained.

Although, in the first embodiment, the upper region 2U of the fin 2 has been formed in a recessed and raised shape, or a wave-like shape, the upper portion 2U is not limited to the above shape and may be formed in a substantially triangular shape, in a shape having separate protrusions, or in a randomly recessed and raised shape. In any of these cases, the same effect can also be acquired.

In addition, although the fins 2 have been formed spirally on the internal face of the heat transfer tube 100 in this embodiment, the formation of the fins are not limited to this and fins may be formed like a ring.

A method for manufacturing the above described heat transfer tube 100 in the first embodiment in FIG. 1 will be briefly described. An electrically seamed steel pipe manufacturing method is employed in this embodiment. More specifically, first, a fin base material 2 is formed upright on a substantially plate member by a first pressing process, and the upper portion of the thus processed fin base material 2 is formed into a wave-like shape by a second pressing process, so as to provide the upper region 2U. The shape of the lower portion of the fin base material 2 remains as it is and serves as the lower region 2L.

The second pressing process will be explained by using one portion of the fin base material 2. In the second pressing process, the fin base material is pushed into a die from the top of the material to engage it and to form the wave-like upper portion of the fin. While one die used for the second pressing maintains the wave shape, a half cycle portion of the die is thicker in the direction of the height for forming half of a wave shape. An adjacent die for the other half presses against the opposite side of the upper portion of the fin with the former die to form a half cycle of the wave shape. The die set for the second pressing process is so provided that these dies are alternately and sequentially arranged on the right and left side of the fins, and pressure is applied to the upper portions of the fin. In the cross section of the fin, the left hand die presses against the upper portion of the fin to the right, and the right hand die presses against the upper portion to the left. As a result, waves that are perpendicular to the upright face of the fin can be formed as is shown in FIG. 1. When all the fins on the almost flat member have been given a wave-like shape, the widthwise ends of the member are bonded together by welding to produce the cylindrical heat transfer tube 100.

A second embodiment of the present invention will now be described while referring to FIGS. 17*a* and 17*b*. In the first embodiment, the recessed and raised shape, or the wave-like shape, of the upper portion of the fin is provided perpendicular to the longitudinal cross section of the fin. By employing the same idea, also when the recessed and raised shape, or the wave-like shape, is formed in the direction of the longitudinal cross section of the fin, the heat transfer performance is improved. FIG. 17 is a perspective view of the area of a fin 202, which is the essential portion of the heat exchanger tube 200 (corresponding to FIG. 12 in the first embodiment). An upper region 202U of the fin 202 is so formed by pressing, in a press, a fin material 212, of which shape of the longitudinal cross section parallel to an internal face of the heat transfer tube 200 is substantially straight, or by providing cuts 218 in the material 212. In other words, a so-called electrically seamed steel pipe production method is employed to manufacture the heat transfer tube 200. The fin base material 212 is provided for a substantially plate member, and the pressing-in or cutting process is performed on the upper portion of the fin base material 212 by the above described press to provide the upper region 202U. The lower portion of the fin base material 212 remains as it is to serve as a lower region 202L. Both ends of the plate member in the widthwise direction are welded together to provide the cylindrical heat transfer tube 200. The other structure is almost the same as that in the first embodiment.

In the second embodiment as well as in the first embodiment, during condensation, the raised portion in the recessed and raised shape, or in the wave-like shape, acts on the liquid to pull it down to the grooves of the finned tube, and the heat transfer performance is enhanced. Further, during evaporation, the recessed portion acts on the liquid that is retained in the grooves of the finned tube to pull it up to the upper region 202U, and the heat transfer performance is improved.

Since the only difference from the first embodiment is that the amplitude in the recessed and raised shape or the wave shape is directed perpendicular or horizontal, the pitches of the amplitude can be determined by employing the same idea as that for the first embodiment.

Figure 17A:
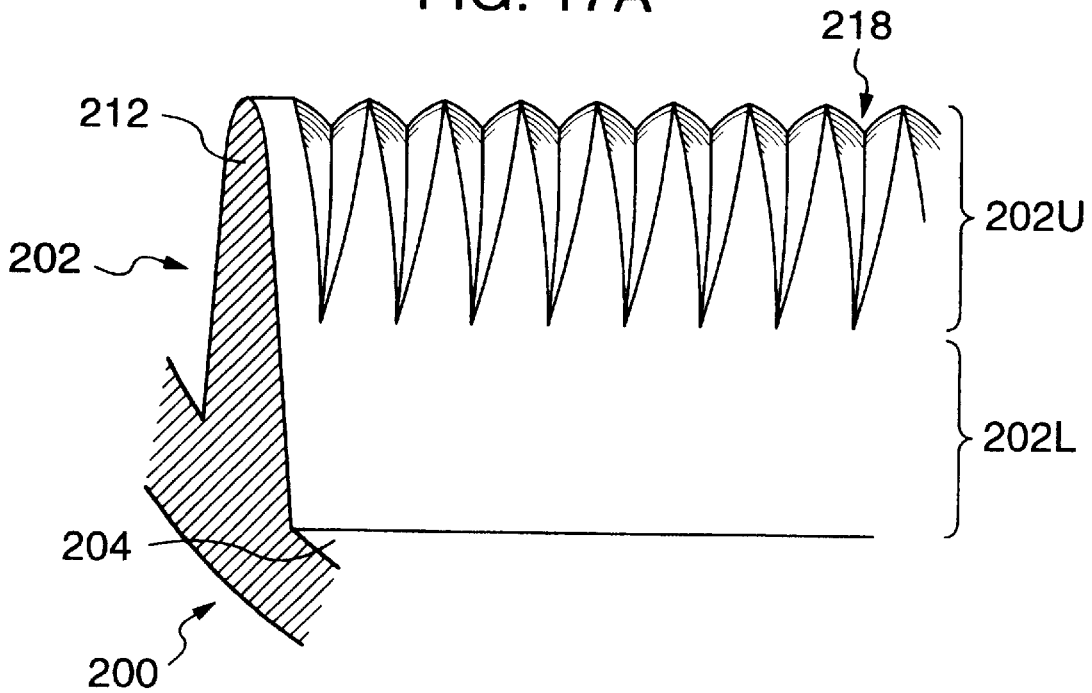
FIGS. 17A and 17B are perspective views of the vicinity of a fin end that is the essential portion of a heat transfer tube according to a second embodiment of the present invention.
Figure 17B:
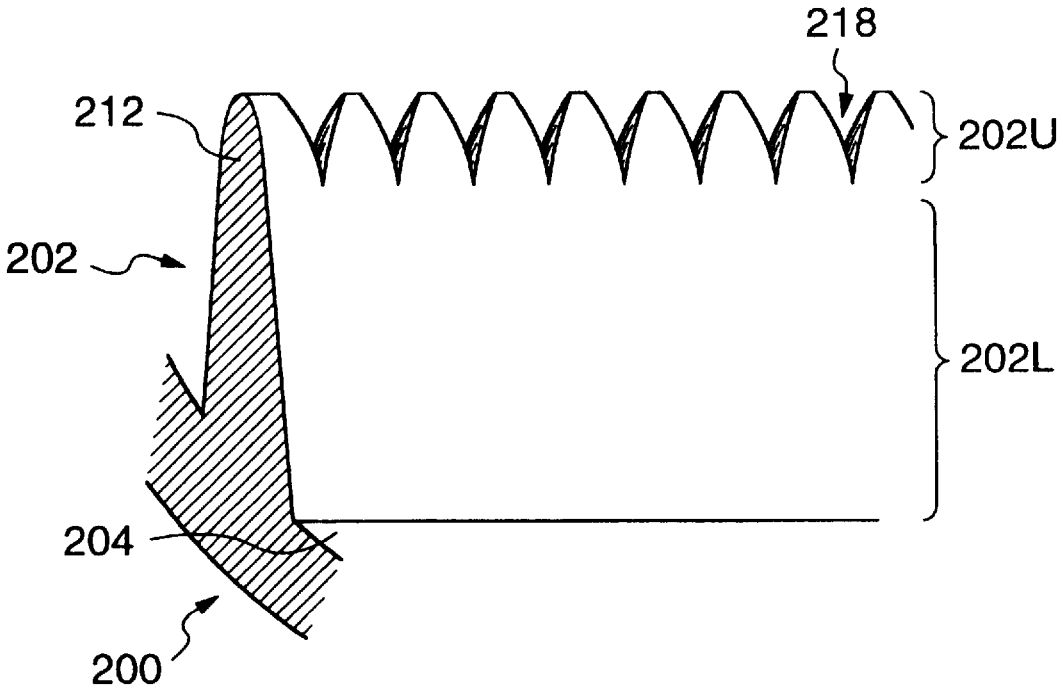

In FIG. 17*a*, grooves are formed even in the side face of the upper region 202U. While the method used for forming these grooves is easier than the formation method used in the first embodiment, it is difficult to process the side faces of the fin. The structure in FIG. 17*b* resolves this problem. This is formed only by using the press to make cuts, and such a structure is comparatively easy to produce.

The above described electrically seamed steel pipe production method can be applied for the fabrication of the heat transfer tube 100 in the first embodiment.

A third embodiment of the present invention will now be described while referring to FIG. 18. In this embodiment, a heat transfer tube has differently shaped fins.

Figure 18:
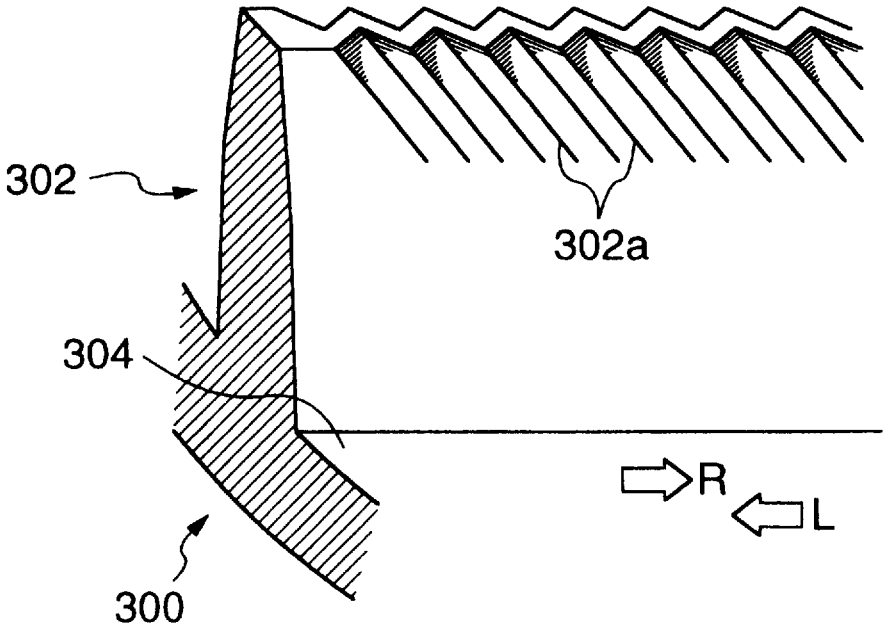
FIG. 18 is a perspective view of the vicinity of a fin end that is the essential portion of a heat transfer tube according to a third embodiment of the present invention.

FIG. 18 is a perspective view of the area at the end of a fin 302, which is the essential portion of a heat transfer tube 300 in this embodiment. FIG. 18 substantially corresponds to FIG. 12 in the first embodiment and FIGS. 17*a* and 17*b* in the second embodiment.

In FIG. 18, the differences between this embodiment and the first embodiment are that the upper portion of a fin 302 has an almost triangular recessed and raised shape, and that ridgelines 302*a*, on the side of the fin 302, are slanted relative to an internal face 304 of the heat transfer tube 300, instead of being perpendicular thereto.

The other structure is almost the same as that of the first embodiment.

The same effect as is obtained in the first embodiment is also acquired in this embodiment.

In addition to this, upon the heat transfer with condensation, when a refrigerant is supplied in a direction (direction indicated by R), in which the ridgelines 302*a* are inclined from the distal end of the fin 302 to the root relative to the flow direction, the liquid film that is formed on the distal end of the fin 302 can be discharged better, and the heat transfer performance can be improved. Further, upon the heat transfer with boiling, when the refrigerant is supplied in a direction (direction indicated by L), in which the ridgelines 302 are inclined from the root to the distal end of the fin 302 relative to the flow direction, the wetted area can be increased by the shearing force that acts on the vapor-liquid surface, and the heat transfer performance can be enhanced.

A fourth embodiment of the present invention will now be described while referring to FIG. 19. In this embodiment, a heat transfer tube has differently shaped fins.

Figure 19:
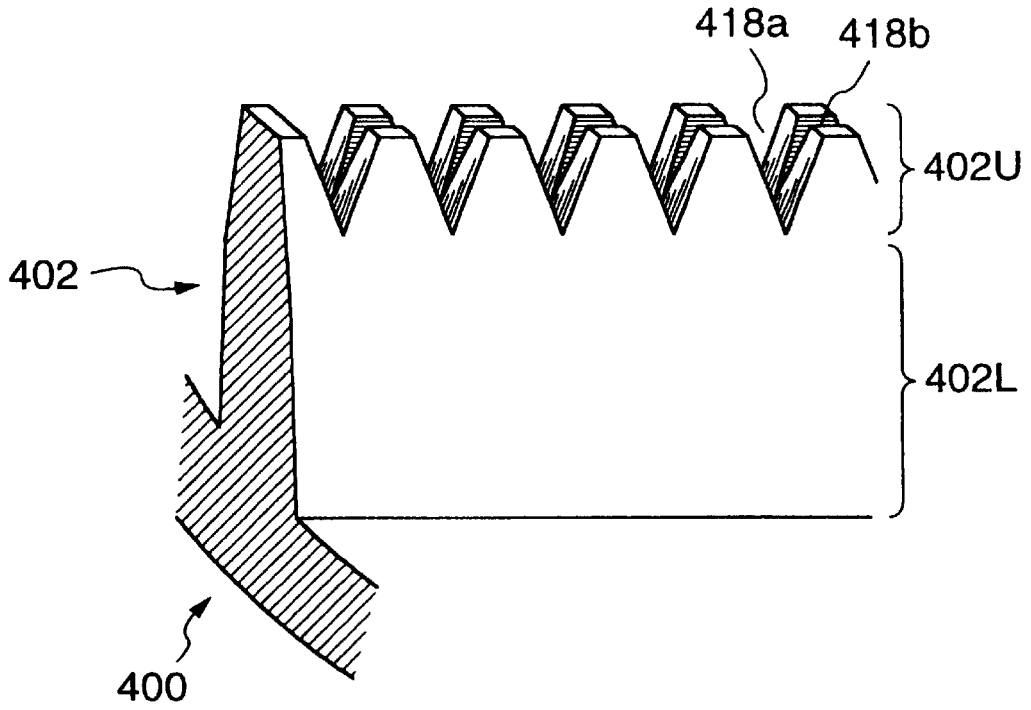
FIG. 19 is a perspective view of the vicinity of a fin end that is the essential portion of a heat transfer tube according to a fourth embodiment of the present invention.

FIG. 19 is a perspective view of the area at the end of a fin 402, which is the essential portion of a heat transfer tube 400 in this embodiment. FIG. 19 substantially corresponds to FIG. 12 in the first embodiment, FIGS. 17*a* and 17*b* in the second embodiment, and FIG. 18 in the third embodiment.

In FIG. 19, the difference between the fourth embodiment and the first embodiment is that an upper portion 402 of the fin 402 is formed as three-dimensional protrusions by a plurality of cuts 418*a* and 418*b* that are made at different angles.

Since multiple separate protrusions with a small radius of curvature are formed, the discharge of condensed liquid film can be further promoted. As a result, the heat transfer with condensation is further improved.

The other structure is almost the same as that in the first structure.

A fifth embodiment of the present invention will now be described while referring to FIG. 20. In this embodiment, a heat transfer tube has differently shaped fins.

Figure 20:
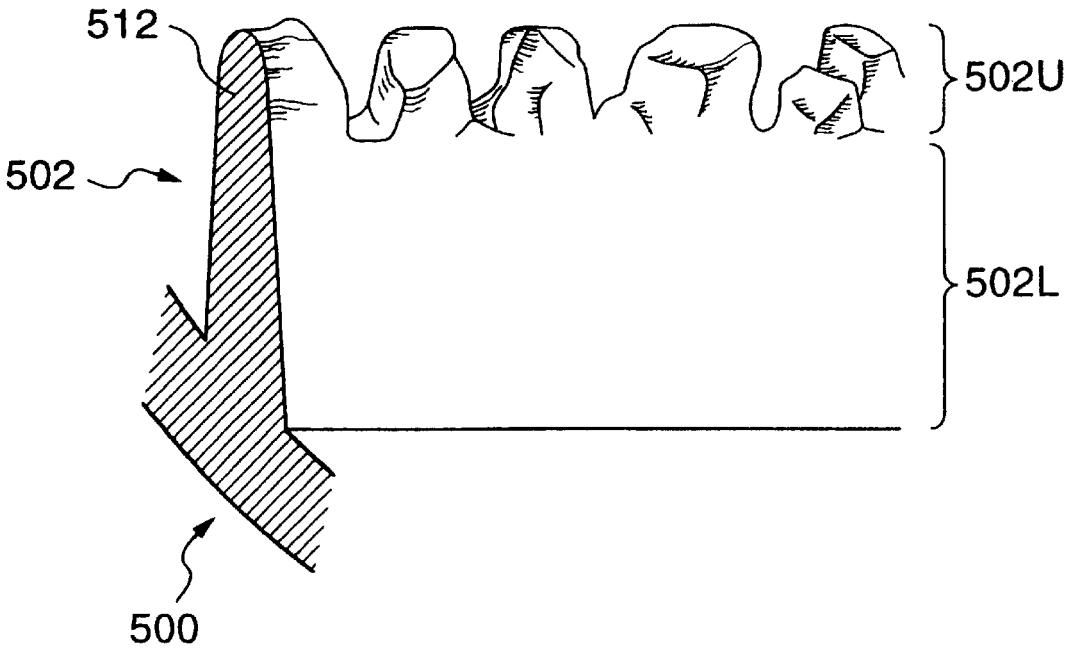
FIG. 20 is a perspective view of the vicinity of a fin end that is the essential portion of a heat transfer tube according to a fifth embodiment of the present invention.

FIG. 20 is a perspective view of the area at the end of a fin 502, which is the essential portion of a heat transfer tube 500 in this embodiment. FIG. 20 substantially corresponds to FIG. 12 in the first embodiment, FIGS. 17*a* and 17*b* in the second embodiment, FIG. 18 in the third embodiment, and FIG. 19 in the fourth embodiment.

In FIG. 20, the difference between the fifth embodiment and the first embodiment is that an upper portion 502U of the fin 502 is recessed and raised at random. More specifically, a so-called electrically seamed steel pipe manufacturing method is employed to produce the heat transfer tube 500 in this embodiment. First, a fin base material 512 is formed on a plate member having a uniform roughness by pressing to maintain the roughness only at the distal fin end. Then, both ends of the plate member in the widthwise direction are bonded together to provide the cylindrical heat exchanger tube 500. Since, in this embodiment, recessed and raised portions at the distal fin end have been formed on a a row plate, the heat transfer tube is easily manufactured at a low cost.

The other structure is almost the same as that in the first structure.

A sixth embodiment of the present invention will now be explained while referring to FIG. 21. In this embodiment, fins of a heat transfer tube are formed of discontinuous segments.

Figure 21:
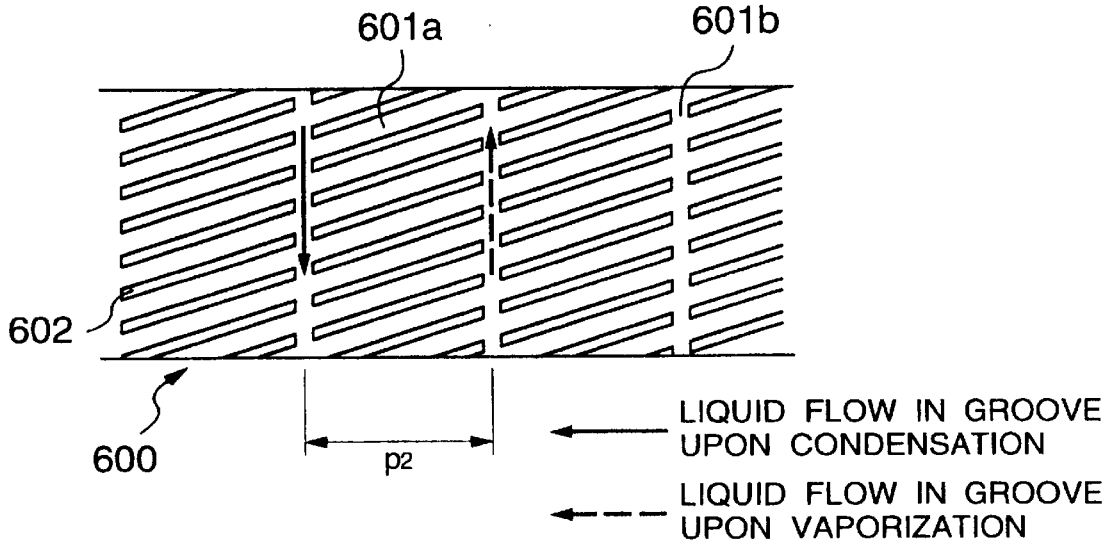
FIG. 21 is a longitudinal cross sectional view of a heat transfer tube according to a sixth embodiment of the present invention.
Figure 22:
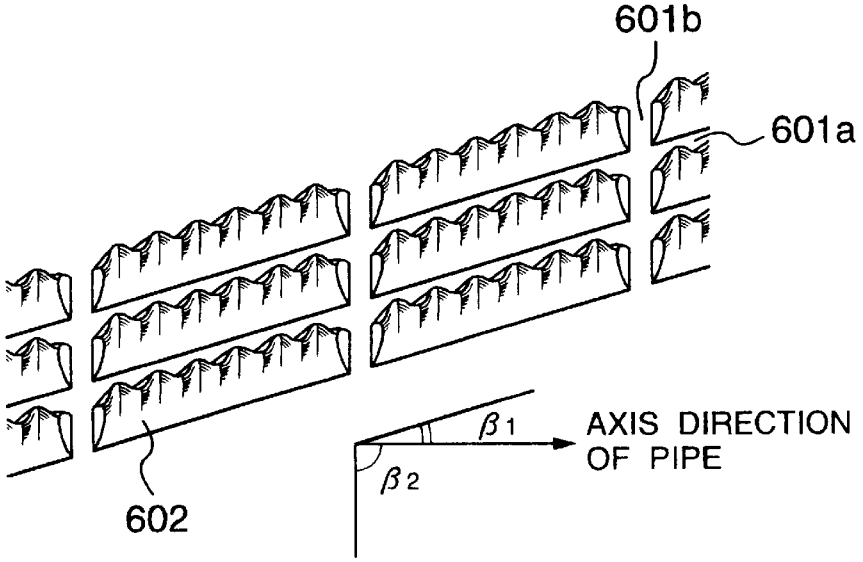
FIG. 22 is a perspective view of the vicinity of a fin end that is the essential portion of the heat transfer tube according to the sixth embodiment of the present invention.

FIGS. 21 and 22 are longitudinal cross sectional views of a heat transfer tube 600 in this embodiment.

In FIG. 21, the distal end of a fin 602 is processed as in the first through the fifth embodiment, and the fin 602 is cut and separated into segments by secondary grooves 601*b* that have a large spiral angle and a large pitch. The secondary grooves 601*b*, which have a large spiral angle and a large pitch, facilitate the flow of condensed liquid during condensation, and facilitate the supply of liquid to the top of the tube during evaporation.

The secondary grooves 601*b*, which have a large spiral angle and a large pitch, are formed to provide the flow of liquid across grooves 601*a*. This structure facilitates the flow of liquid from the tube top during condensation and prevents the overflow of the liquid from the grooves 601*a* and the deterioration of the heat transfer performance. During evaporation with this structure, liquid can be immediately supplied to an area where the supply of liquid has been almost exhausted, and the heat transfer performance is thereby improved. Since the secondary grooves 601*b* are employed to provide a flow in the gravitational direction across the grooves 601*a*, it is preferable that, for a horizontal tube, the spiral angle of the grooves 601*b* to the axial direction of the tube be close to 90 degrees. Thus, $\beta 2=90°\pm 20°$ is preferable. In addition, since it is sufficient to provide 20 secondary grooves in one cycle of the primary groove 601*a* that has a spiral angle of $\beta 1$, the grooves 602*a* may be provided so as to satisfy the relation $p2 \geq (\pi di/\tan \beta 1)/20$. Here (di) defines the maximum internal diameter. When di=6.5 mm, for example, the relation becomes $p2 \geq 2.8$ mm. When the pitches of the secondary grooves 601*b* are smaller than that, the flow along the primary grooves 601*a* may be interrupted, and the heat transfer performance will be deteriorated.

Furthermore, since, as is described above, the secondary grooves 601*b* are so formed that the liquid can easily flow across the primary grooves 601*a*, the grooves 601*b* are preferably as deep as possible. In other words, while the secondary grooves 601*b* are formed down to the fin root in FIG. 22, the depth of the secondary grooves 601*b* must be the equivalent of 50% or more of the fin height.

A seventh embodiment of the present invention will now be described while referring to FIG. 23. In this embodiment, a heat transfer tube has externally formed fins.

Figure 23:
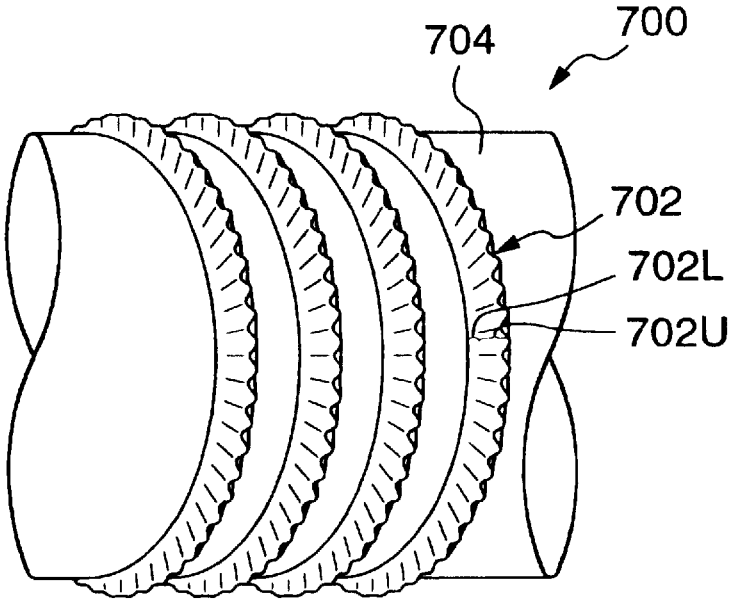
FIG. 23 is a side view of the structure of the vicinity of a fin end that is the essential portion of a heat transfer tube according to a seventh embodiment of the present invention.

FIG. 23 is a side view of the structure of the area at the end of a fin 702, which is the essential portion of a heat transfer tube 700 in this embodiment.

In FIG. 23, the heat transfer tube 700 is used for a so-called shell-and-tube type heat exchanger wherein a refrigerant is condensed on the outer face of a tube. A series of ring shaped fins 702 are formed around the outer face. Each of the fins 702 has a structure that is similar to that of the fin 2 in the first embodiment. The fin 702 has an upper region 702U, which has a recessed and raised outline, or a wave-like outline in a cross section that is parallel to an outer face 704 of the heat transfer tube 700; and a lower region 702L, which has a substantially straight shape in the transverse cross section that is parallel to the outer face 704 of the heat transfer tube 700. In the upper region 702U, the radius of curvature of the recessed and raised portions of the distal fin end in a cross section in parallel with the outer face 704 of the heat transfer tube 700 is approximately equal to the radius of curvature of the raised portions in a cross section perpendicular to the external face 704 (the same idea as that in the first embodiment).

For the finned heat transfer tube 700 in the seventh embodiment, as well as the finned heat transfer tubes 100 through 600 in the first through the sixth embodiment, performance of the heat transfer with condensation and with evaporation can be improved by forming the upper region 702U, which has the wave-like shape or the recessed and raised shape in the cross section parallel to the outer face 704. The lower region 702L, which has the substantially straight outline in the cross section parallel to the outer face 704, does not adversely affect the improvement in the heat transfer performance at the upper region 702U. Further, the fin 702 can be easily and accurately formed.

Although, in the seventh embodiment shown in FIG. 23, the fins 702 are shaped similar to the fins 2 in the first embodiment, the fin shape is not limited to this, and may be similar to the shapes of the fins in the second through the sixth embodiment. In all cases, the same effect can be obtained.

An eighth embodiment of the present invention will now be described while referring to FIG. 24. In this embodiment provided is a thin film heat transfer surface that is used for cooling computers.

Figure 24:
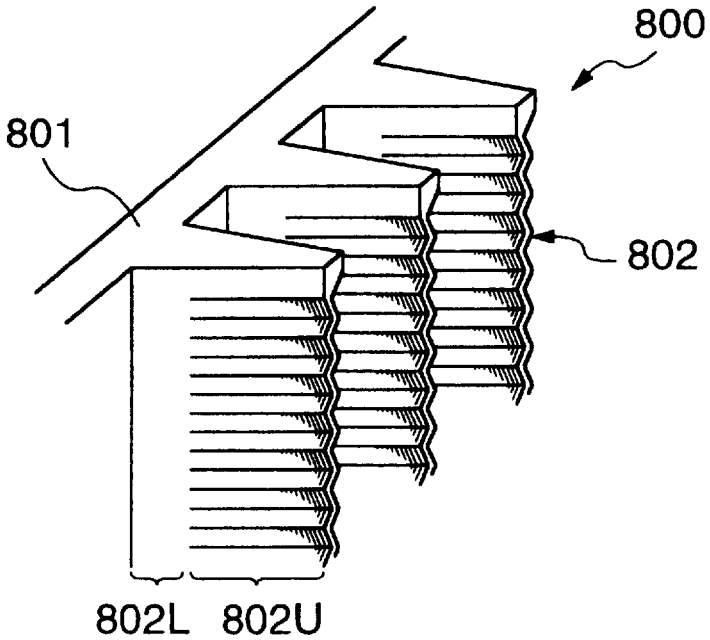
FIG. 24 is a perspective view of the vicinity of a fin end that is the essential portion of a thin film heat transfer surface according to an eighth embodiment of the present invention.

FIG. 24 is a perspective view of the area at the ends of fins 802 that are formed for a thin film heat transfer surface 800.

In FIG. 24, the thin film heat transfer surface 800 includes a flat base member 801 and a plurality of fins 802 that are formed upright on the base member 801. Each of the fins 802 is formed similar to the fins 2 shown in FIG. 12. The fin 802 has an upper region 802U, which has a recessed and raised outline, or a wave-like outline, in a cross section parallel to the base material 801; and a lower region 802L, which has a substantially straight outline in a cross section parallel to the base material 801. In addition, the radius of curvature of the recessed and raised shape of the distal fin end in cross a section parallel with the base member 801 is approximately equal to the radius of curvature of the raised shape in a cross section perpendicular to the base member 801 (the same idea as that in the first embodiment). It should be noted that the fins 802 are different from the fins 2 in the first embodiment in that they are arranged in a straight line, not spirally.

For the heat transfer surface 800 in the eighth embodiment, as well as for the finned heat transfer tubes 100 through 700 in the first through the seventh embodiment, the performance of the heat transfer with condensation and with evaporation can be improved by forming the upper region 802U, which has the wave-like outline in a cross section parallel to the base member 801. Also, the lower region 802L, which has the substantially straight outline in a cross section parallel to the base member 801, does not adversely affect the improvement in the heat transfer performance at the upper region 802U. Further, the fin 802 can be easily and accurately formed.

Although, in the eighth embodiment, the fins 802 are shaped similar to the fins 2 in FIG. 12, the fin shape is not limited to this, and may be similar to the shape of the fins 2 in FIG. 1 or of the fins in the second through the sixth embodiment. In all cases, the same effect can be obtained.

A ninth embodiment of the present invention will now be explained while referring to FIGS. 25 and 26. In this embodiment a heat exchanger is provided that incorporates the heat transfer tubes 100 of the first embodiment. The same reference numerals as are used in the first embodiment are also used in this embodiment to denote corresponding or identical components.

Figure 25:
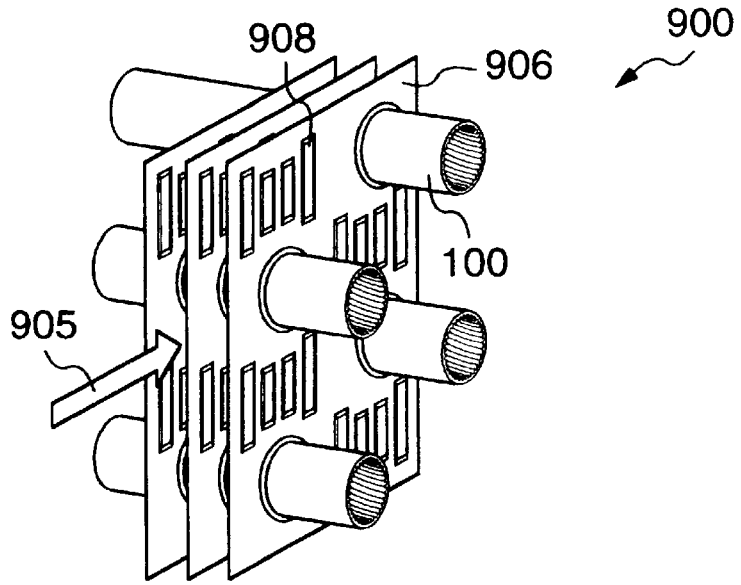
FIG. 25 is a partial perspective view of the schematic structure of a heat exchanger according to a ninth embodiment of the present invention.

FIG. 25 is a schematic, partial perspective view of the structure of a heat exchanger 900 according to the present embodiment. In FIG. 25, the heat exchanger 900 is referred as a cross finned tube type heat exchanger wherein the heat transfer tubes 100 of the first embodiment are inserted through multiple parallel fins 906 that are positioned in parallel. Louvers 908 are formed on the surfaces of the parallel fins 906 to improve the heat transfer rate to the air.

Although the detailed structure of the heat transfer tube 100 is not shown, as is described in the first embodiment, each fin on the internal face has an upper region, which has a recessed and raised shape or a wave-like shape in a cross section parallel to the internal face; and a lower portion that has a substantially straight shape in a cross section parallel to the internal face, with the radius of curvature of the wave shape at the distal fin end being equal to or greater than the radius of curvature of the raised shape.

With the above described arrangement, an air stream 905 enters in the direction that is perpendicular to the axes of the heat transfer tubes 100, flows through the parallel fins 906, and is cooled by the heat transfer tubes 100, through which a refrigerant flows.

With the heat exchanger 900 in this embodiment, the overall heat transfer coefficient, which is an index representing the general heat transfer function of a heat exchanger, can be improved in consonance with the enhancement of the refrigerant-side heat transfer effect by the finned heat transfer tubes 100 of the first embodiment. This overall heat transfer coefficient includes an air-side heat transfer rate, a refrigerant-side heat transfer rate and a contact resistance. The effect provided by the improvement of the overall heat transfer coefficient will be specifically described with referring to FIG. 26.

Figure 26:
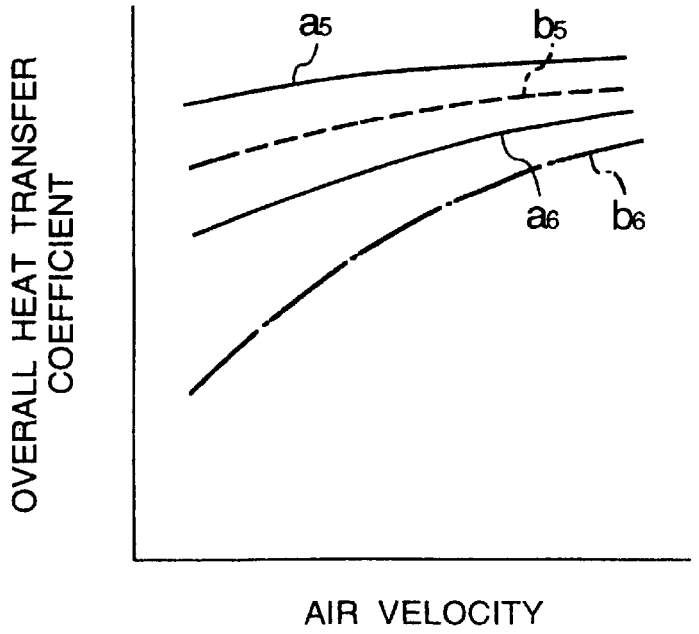
FIG. 26 is a graph, for a heat exchanger incorporating the heat transfer tube in FIG. 1 and a heat exchanger incorporating the conventional heat transfer tube in FIG. 3, showing the overall heat transfer coefficients obtained when a single refrigerant is used and when a non-azeotropic mixture refrigerant is used.

The graph in FIG. 26 shows the overall heat transfer coefficients for the heat exchanger 900 of this embodiment, which incorporates the finned heat transfer tubes 100, and for a conventional heat exchanger, which incorporates the previously described finned heat transfer tube 150 (see FIG. 3), when a single refrigerant (HCFC-22) is made flow therein and when a non-azeotropic mixture refrigerant is made flow therein.

In FIG. 26, curve (b5) describes the results obtained when the single refrigerant flows in the conventional heat exchanger, and curve (b6) describes the results obtained when the non-azeotropic mixture refrigerant flows. Curve (a5) describes the results obtained when the single refrigerant flows in the heat exchanger 900 of this embodiment, and curve (a6) describes the results obtained when the non-azeotropic mixture refrigerant flows in the heat exchanger 900 of this embodiment. The horizontal axis represents an air flow velocity.

As is apparent from FIG. 26, both when the single refrigerant is used and when the non-azeotropic mixture refrigerant is used, the overall heat transfer coefficients for the heat exchanger 900 of this embodiment are improved across a wide air flow velocity range, when compared with the overall heat transfer coefficients for the conventional heat exchanger.

Since the curve (a6) and the curve (b5) are comparatively close to each other, it is found that when the non-azeotropic mixture refrigerant is used for the heat exchanger 900 of this embodiment, the acquired overall heat transfer coefficient is close to that obtained when the single refrigerant flows in the conventional heat exchanger. Therefore, it is apparent that the heat transfer tube 100 of the first embodiment is very excellent when employed as a heat transfer tube for a heat exchanger that uses a non-azeotropic mixture refrigerant.

Although the heat exchanger 900 in the ninth embodiment has employed the heat transfer tube 100 of the first embodiment, any other heat transfer tube can be employed, such as the heat transfer tubes in the second through the sixth embodiment. In all cases, the same effect can be obtained.

A tenth embodiment of the present invention will now be described while referring to FIGS. 27, 28 and 29. In this embodiment, provided is an air conditioner that incorporates the heat exchanger 900 of the ninth embodiment. The same reference numerals as are used in the ninth embodiment are also used in this embodiment to denote corresponding or identical components.

Figure 27:
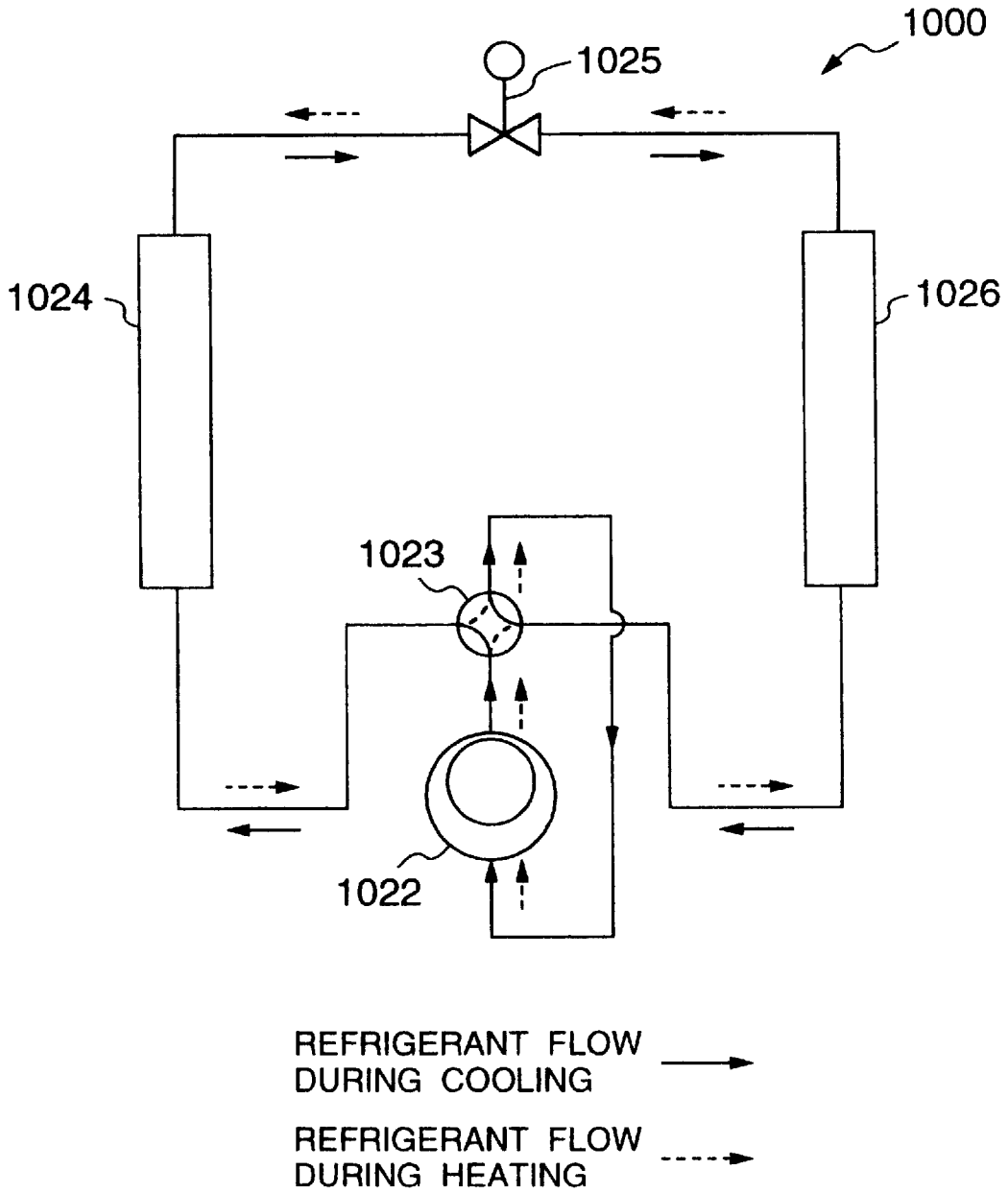
FIG. 27 is a conceptual diagram of the general system of an air conditioner according to a tenth embodiment of the present invention.

FIG. 27 is a conceptual diagram illustrating the general structure of an air conditioner 1000 according to this embodiment. In FIG. 27, the air conditioner 1000 forms a heat pump refrigeration cycle using a non-azeotropic refrigerant, and comprises an indoor heat exchanger 1026 that is located indoors; an outdoor heat exchanger 1024 that is located outdoors; a compressor 1022 that is connected to both heat exchangers 1026 and 1024; a four-way valve 1023 that changes the flow of a refrigerant for cooling and for heating; and an expansion valve 1025.

The heat exchanger 900 of the ninth embodiment is employed as the indoor heat exchanger 1026 and the outdoor heat exchanger 1024. During cooling, for which the four-way valve 1023 is switched and its configuration is as indicated by the solid lines, the indoor heat exchanger 1026 serves as an evaporator and the outdoor heat exchanger 1024 serves as a condenser. During heating, for which the four-way valve 1023 is switched and its configuration is as indicated by the broken lines, the indoor heat exchanger 1026 serves as a condenser and the outdoor heat exchanger 1024 serves as an evaporator.

For the air conditioner 1000 in this embodiment, the coefficient of performance (COP), which is a value obtained by dividing a cooling capacity (or a heating capacity), by the total electrical input, can be improved in consonance with the improvement in the overall heat transfer coefficient for the heat exchanger 900 of the ninth embodiment. The effect derived from the improvement in the coefficient of performance will be specifically explained while referring to FIG. 28.

The coefficient of performance when the single refrigerant (HCFC-22) was employed was measured for the air conditioner 1000 in this embodiment, which employs as the indoor heat exchanger 1026 and the outdoor heat exchanger 1024 the heat exchanger 900 that incorporates the finned heat transfer tubes 100 (see FIG. 1), and for a conventional air conditioner, which employs as the indoor heat exchanger 1026 and the outdoor heat exchanger 1024 the heat exchanger that incorporates the conventional finned heat transfer tube 150 (see FIG. 3). The ratio (%) of these coefficients are shown in FIG. 28.

Figure 28:
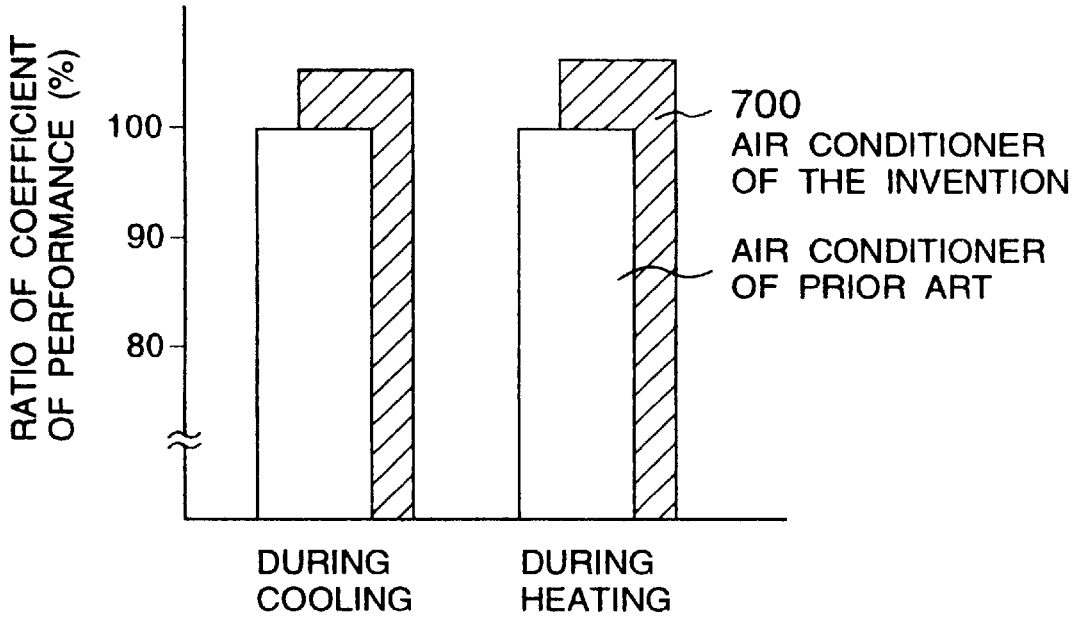
FIG. 28 is a graph showing ratios of the coefficients of performance when a single refrigerant is used for an air conditioner that employs a heat exchanger incorporating the heat transfer tube shown in FIG. 1 and for a conventional air conditioner that employs a heat exchanger incorporating the conventional heat transfer tube shown in FIG. 3.

As is shown in FIG. 28, both during the cooling and during the heating, the coefficient of performance for the air conditioner of this embodiment was improved when compared with that for the conventional air conditioner. Therefore, an efficient, compact, air conditioning refrigerator/air conditioner can be provided.

Then, for the air conditioner 1000 of this embodiment and a conventional air conditioner, which employs a heat exchanger that incorporates the conventional finned heat transfer tube 150 (see FIG. 3) as the indoor heat exchanger 1026 and the outdoor heat exchanger 1024, the coefficient of performance was measured when the single refrigerant (HCFC-22) was used and when a non-azeotropic mixture refrigerant (a refrigerant obtained by mixing HFC-32, HFC-125 and HFC-134a at 30, 10 and 60 wt %) was used. The ratio of these coefficients was calculated and is shown in FIG. 29.

Figure 29:
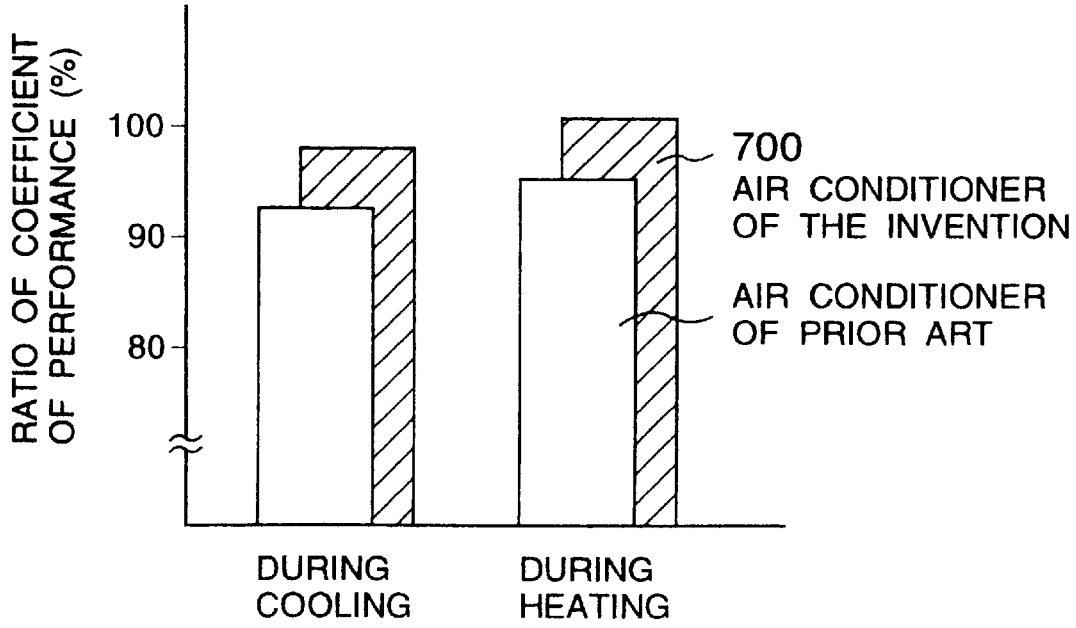
FIG. 29 is a graph showing ratios of the coefficients of performance when a single refrigerant and a non-azeotropic mixture refrigerant are used for an air conditioner that employs a heat exchanger incorporating the heat transfer tube shown in FIG. 1 and for a conventional air conditioner that employs a heat exchanger incorporating the conventional heat transfer tube shown in FIG. 3.

As is shown in FIG. 29, during both the cooling and the heating, the coefficient of performance (COP) of the conventional air conditioner was reduced by about 93 to 95% when the single refrigerant was replaced by the non-azeotropic mixture refrigerant. For the air conditioner 1000 of this embodiment, however, even when the single refrigerant was replaced by the non-azeotropic mixture refrigerant, the acquired coefficient of performance remained near that obtained for the conventional air conditioner when the single refrigerant was used. Therefore, an efficient, compact, air conditioning refrigerator/air conditioner can be provided for a non-azeotropic mixture refrigerant.

Although in the tenth embodiment the heat exchanger 900 has been used for an air conditioner, the heat exchanger 900 can be applied in the same manner for a refrigerator.

The fins in the above embodiments are formed spirally in the heat exchanger tube. When internal fins are arranged in a pine-needle shape, as will be described later, the effect obtained in the above embodiments will not be lost.

Figure 30:
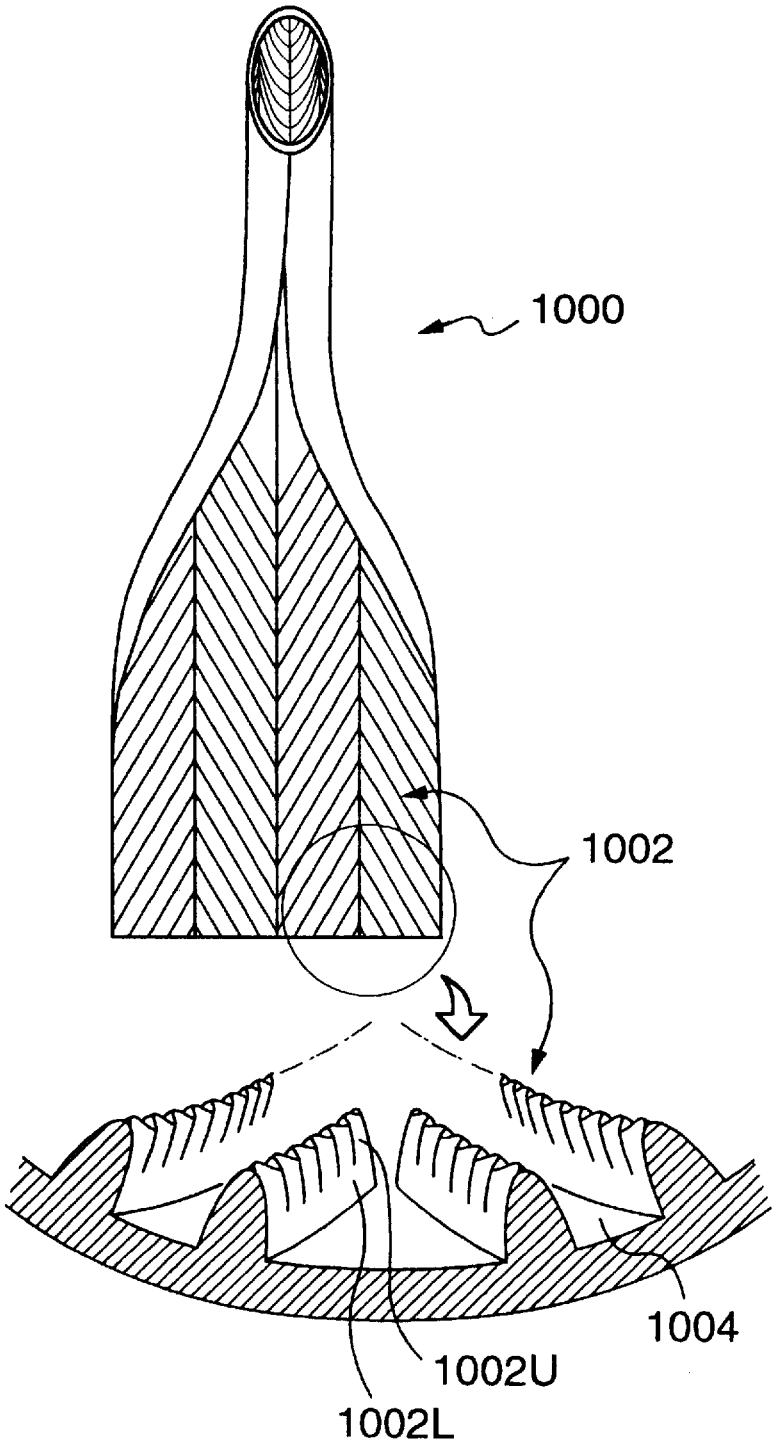
FIG. 30 is a diagram of the development of a heat transfer tube according to a modification and an enlarged diagram of the heat transfer tube.

FIG. 30A depicts the development of a heat transfer tube 1000, and FIG. 30B is an enlarged diagram of the tube 1000. The spiral angle of internal fins 1002 of the heat transfer tube 1000 are discontinuously changed into a pine-needle shape. The internal fin 1002 is shaped as is described in the first embodiment. The internal fin 1002 has an upper region 1002U, which has a recessed and raised shape, or a wave-like shape, in a cross section parallel to an internal face 1004 of the heat transfer tube 1000; and a lower region 1002L, which has a substantially straight shape in a cross section parallel to the internal face 1004 of the tube 1000. The pitches of the recessed and raised shape, or the wave-like shape, are determined in the same manner as in the first embodiment.

According to the finned heat transfer tube of the present invention, since the first portion at the upper area of the fin on the internal face of the tube is formed in a wave-like shape or in a recessed and raised shape in a cross section parallel to the heat transfer tube face, the performance of the heat transfer with condensation and with evaporation can be enhanced. At this time, the second portion at the lower area of the fin is so formed that it has a substantially straight shape in a cross section parallel to the tube face, and the heat transfer performance is not deteriorated. As machining is not required for the second portion, on the whole, accurate and easy processing can be performed.

What is claimed is:

1. A heat exchanger, in which a plurality of fins formed on an internal face of a heat transfer tube, wherein each of said plurality of fins has a first portion including a fin top and a second portion including a fin root, and wherein said first portion has a ridgeline formed in a raised and recessed shape, or in a wave-like or corrugated shape, and said second portion has a substantially straight outline in a fin longitudinal direction in a cross section parallel to said internal face on which said plurality of fins are formed.

2. A heat exchanger according to claim 1, wherein said ridgeline of said first portion is so formed that the amplitude direction of said raised and recessed shape, or said wave-like shape, of said ridgeline is along said internal face of said heat transfer tube.

3. A heat exchanger according to claim 1, wherein said ridgeline of said first portion is so formed that the amplitude direction of said raised and recessed shape, or said wave-like shape, of said ridgeline is perpendicular to said internet face of said heat transfer tube.

4. A heat exchanger according to claim 1, wherein said raised and recessed shape, or said wave-like shape, of said first portion along said ridgeline is provided by a randomly raised and recessed face.

5. A heat exchanger according to claim 1, wherein the amplitude and the cycle of said raised and recessed shape, or said wave-like shape, formed along said ridgeline of said first portion are determined in consonance with the dimension of an upper portion of said fin in said cross section.

* * * * *